US007264978B2

(12) United States Patent
Ito

(10) Patent No.: US 7,264,978 B2
(45) Date of Patent: Sep. 4, 2007

(54) FIELD EMISSION TYPE COLD CATHODE AND METHOD OF MANUFACTURING THE COLD CATHODE

(75) Inventor: Fuminori Ito, Tokyo (JP)

(73) Assignee: NEC Corporation, Tokyo (JP)

( * ) Notice: Subject to any disclaimer, the term of this patent is extended or adjusted under 35 U.S.C. 154(b) by 207 days.

(21) Appl. No.: 10/481,130

(22) PCT Filed: Jun. 18, 2002

(86) PCT No.: PCT/JP02/06049

§ 371 (c)(1),
(2), (4) Date: Dec. 18, 2003

(87) PCT Pub. No.: WO02/103739

PCT Pub. Date: Dec. 27, 2002

(65) Prior Publication Data

US 2004/0174110 A1 Sep. 9, 2004

(30) Foreign Application Priority Data

Jun. 18, 2001 (JP) ..... 2001-182871

(51) Int. Cl.
*H01J 1/02* (2006.01)

(52) U.S. Cl. ..... 438/20; 313/309; 313/351; 977/742; 977/939

(58) Field of Classification Search ..... 438/20–22, 438/48; 257/10; 313/306–310, 351–353, 313/495–497, 336; 977/DIG. 1, 742, 939
See application file for complete search history.

(56) References Cited

U.S. PATENT DOCUMENTS 3,789,471 A * 2/1974 Spindt et al. ..... 445/52
5,214,347 A * 5/1993 Gray ..... 313/355
5,315,206 A * 5/1994 Yoshida ..... 313/306
5,382,185 A * 1/1995 Gray et al. ..... 445/49
5,656,525 A * 8/1997 Lin et al. ..... 216/11
5,679,960 A * 10/1997 Akama ..... 257/10
5,757,138 A * 5/1998 Tsai ..... 315/169.3
5,801,477 A * 9/1998 Macaulay ..... 313/309
6,005,335 A * 12/1999 Potter ..... 313/309
6,008,062 A * 12/1999 Knall ..... 438/20
6,015,324 A * 1/2000 Potter ..... 445/24
6,028,391 A 2/2000 Makishima
6,075,315 A * 6/2000 Seko et al. ..... 313/336
6,121,102 A * 9/2000 Norstrom et al. ..... 438/361

(Continued)

FOREIGN PATENT DOCUMENTS

JP 63-261878 * 10/1988

(Continued)

*Primary Examiner*—B. William Baumeister
*Assistant Examiner*—Matthew W. Such
(74) *Attorney, Agent, or Firm*—Young & Thompson

(57) ABSTRACT

A field emission type cold cathode, comprising a substrate having a conductivity at least on the surface thereof, an insulation layer formed on the substate and having a first opening part, a gate electrode layer formed on the insulation layer, having a center generally aligned with the center of the first opening part, and having, therein, a second opening part having an opening diameter larger than the opening diameter of the first opening part, and an emitter layer formed in the first opening part, the emitter layer characterized by further comprising the bottom surface and the side surfaces of the first opening part.

16 Claims, 18 Drawing Sheets

U.S. PATENT DOCUMENTS

| | | | | |
|---|---|---|---|---|
| 6,171,163 | B1 * | 1/2001 | Seko et al. | 445/24 |
| 6,181,060 | B1 * | 1/2001 | Rolfson | 313/495 |
| 6,277,318 | B1 * | 8/2001 | Bower et al. | 264/346 |
| 6,333,598 | B1 * | 12/2001 | Hsu et al. | 313/495 |
| 6,445,124 | B1 * | 9/2002 | Asai et al. | 313/495 |
| 6,448,701 | B1 * | 9/2002 | Hsu | 313/309 |
| 6,642,639 | B2 * | 11/2003 | Choi et al. | 313/309 |
| 6,649,431 | B2 * | 11/2003 | Merkulov et al. | 438/20 |
| 6,657,242 | B1 * | 12/2003 | Norstrom et al. | 257/197 |
| 6,741,019 | B1 * | 5/2004 | Filas et al. | 313/355 |
| 6,815,875 | B2 * | 11/2004 | Kuo et al. | 313/309 |
| 6,852,554 | B2 * | 2/2005 | Chen et al. | 438/20 |
| 2001/0024920 | A1 * | 9/2001 | Tjaden et al. | 445/24 |
| 2001/0040215 | A1 * | 11/2001 | Ahmed et al. | 250/307 |
| 2002/0009943 | A1 * | 1/2002 | Ito | 445/24 |
| 2002/0055319 | A1 * | 5/2002 | Hsu | 445/24 |
| 2002/0160111 | A1 * | 10/2002 | Sun et al. | 427/248.1 |
| 2002/0175618 | A1 * | 11/2002 | Lee et al. | 313/495 |
| 2002/0197752 | A1 * | 12/2002 | Choi | 438/20 |
| 2003/0059968 | A1 * | 3/2003 | Cheng et al. | 438/20 |
| 2003/0090190 | A1 * | 5/2003 | Takai et al. | 313/311 |

FOREIGN PATENT DOCUMENTS

| | | |
|---|---|---|
| JP | 8-231210 | 9/1996 |
| JP | 8-236013 | 9/1996 |
| JP | 9-221309 | 8/1997 |
| JP | 2000-141056 | 5/2000 |
| JP | 2000-156147 | 6/2000 |
| JP | 2000-340098 | 12/2000 |
| JP | 2001-118488 | 4/2001 |

* cited by examiner

FIELD EMISSION TYPE COLD CATHODE AND METHOD OF MANUFACTURING THE COLD CATHODE

FIELD OF THE INVENTION

The invention relates to a field emission type cold cathode available for an electron source in a planar image-displaying apparatus, a cathode ray tube (CRT), an electron microscope, an electron beam exposure unit and various electron beam units, and further to a method of fabricating the same.

DESCRIPTION OF THE PRIOR ART

Recently, carbon nano-tube is expected as a material of which an emitter is composed in a field emission type cold cathode.

Carbon nano-tube is quite minute in the form of a hollow cylinder, and is obtained by spirally rounding a graphene sheet composed of carbon atoms regularly arranged. Carbon nano-tube has a diameter in a nanometer order and a length in the range of 0.5 to a couple of tens micrometers, and has a quite high aspect ratio. Hence, an electric field is likely to be concentrated to a summit of nano-tube, and thus, nano-tube can present a high emission-current density.

In addition, carbon nano-tube is characterized in being chemically and physically stable, and hence, it is considered that nano-tube is not likely to be influenced by absorption of residual gas in vacuum environment and ion bombardment.

There have been suggested many electron-beam sources including nano-tube as a material of which an emitter is composed in a field emission type cold cathode.

FIG. 15 is a cross-sectional view of a field emission type cold cathode suggested in Japanese Patent Application Publication No. 9-221309.

An emitter layer 153 composed of carbon nano-tube is formed by irradiating ions onto a carbon substrate 151. A first electrically conductive layer 154*a*, an electrically insulating layer 152 and a second electrically conductive layer 154*b* are formed on the substrate to surround the emitter layer 153, and on the second electrically conductive layer 154*b* is mounted a grid 155 through which electron beams pass.

The grid 155 is comprised of a mesh composed of copper, and is positioned to cover therewith an opening formed through the first electrically conductive layer 154*a*, the electrically insulating layer 152 and the second electrically conductive layer 154*b*.

Carbon nano-tube of which the emitter layer 153 is composed has a diameter in the range of 2 to 50 nanometers, and a length in the range of 0.01 to 5 micrometers.

The above-identified Publication does not set forth a thickness of the electrically insulating layer 152 and a diameter of the emitter layer 153.

It is set forth in the Publication that if a positive voltage of 500V relative to the emitter layer 153 is applied to the grid 155, electrons are emitted from the emitter layer 153, and resultingly, an emission current of 10 mA is detected in an anode electrode 156 arranged in facing relation to the emitter layer 153.

FIG. 16 is a cross-sectional view of a field emission type cold cathode suggested in Japanese Patent Application Publication No. 2000-141056.

An electrically conductive flat layer 164 is formed on a substrate 165, and an emitter layer 163 composed of adhesive carbon nano-tube is formed on the electrically conductive flat layer 164. On the electrically conductive flat layer 164 is formed an electrically insulating layer 162 surrounding the emitter layer 163, and a gate electrode layer 161 is formed on the electrically insulating layer 162.

The gate electrode layer 161 is formed therethrough with an opening having a diameter smaller than a diameter of an opening formed throughout the electrically insulating layer 162. Hence, the emitter layer 163 faces at a marginal area thereof the gate electrode layer 161, and further, faces at a central area thereof an anode electrode 166.

By applying a positive voltage relative to both of the gate electrode layer 161 and the anode electrode 166 to the emitter layer 163, electrons are emitted from the emitter layer 163, and a part of the thus emitted electrons enter the anode electrode 166.

FIG. 17 is a cross-sectional view of a field emission type cold cathode suggested in Japanese Patent Application Publication No. 2000-340098.

An electrically conductive layer 174 is formed on a substrate 175, and an emitter layer 173 composed of carbon nano-tube cut into short pieces by means of a cutter is formed on the electrically conductive layer 174. On the emitter layer 173 are formed an electrically insulating layer 172 and a gate electrode layer 171 in this order both formed therethrough with an opening through which the emitter layer 173 is partially exposed.

In the suggested field emission type cold cathode, an opening formed throughout the gate electrode layer 171 is equal in diameter to an opening formed throughout the electrically insulating layer 172. The field emission type cold cathode is driven in the same way as the field emission type cold cathode illustrated in FIG. 16.

The above-identified Publication sets forth that there can be obtained a planar image-displaying apparatus including a plurality of the above-mentioned field emission type cold cathodes two-dimensionally arranged on a glass substrate, and a glass substrate (anode) on which phosphor is coated and which faces the field emission type cold cathodes, wherein the field emission type cold cathodes are driven through addresses.

In a field emission type cold cathode including an electrically insulating layer and a gate electrode layer (grid) both surrounding an emitter, it is possible to control electron emission by controlling an electric field generated between a gate electrode layer and an emitter layer. An intensity of an electric field generated between a gate electrode layer and an emitter layer is calculated by dividing a voltage applied to a gate electrode layer by a distance between a gate electrode layer and an emitter layer. A relative distance between a gate electrode layer and an emitter layer is equivalent to a thickness of an electrically insulating layer. That is, a certain emission current can be obtained by applying a higher voltage to a gate electrode layer, if an electrically insulating layer has a greater thickness (a relative distance between a gate electrode layer and an emitter layer), or by applying a lower voltage to a gate electrode layer, if an electrically insulating layer has a smaller thickness (a relative distance between a gate electrode layer and an emitter layer).

Accordingly, it is necessary to arrange an electrode such as a gate electrode layer and a grid as close as possible to an emitter layer in order to accomplish a field emission type cold cathode which can be driven at a low voltage. Ability of driving a field emission type cold cathode at a low voltage is absolutely necessary for accomplishing a high-performance planar apparatus for displaying images therein, because such ability presents advantages of reduced power consumption, down-sizing of a driver circuit, reduction in fabrication cost and suppression of expansion of electron beams.

However, there are caused following problems, if an emitter layer and a gate electrode layer are arranged close to each other to thereby accomplish desired electron-emission characteristic in a field emission type cold cathode including an emitter layer composed of carbon nano-tube.

The first problem is that it is quite difficult to arrange a gate electrode layer and an emitter layer close to each other, that is, to form an electrically insulating layer thin.

Carbon nano-tube obtained by a conventional method of fabricating the same, such as an arc discharge process or a laser ablation process, has an almost uniform outer diameter in a nanometer order, but has various lengths in the range of 0.5 to 100 micrometers.

In addition, since carbon nano-tube is quite flexible, it is likely to be entangled with one another. Hence, if relatively long carbon nano-tubes are entangled with one another, it becomes a piece of thread, reducing flatness of an emitter layer.

If an electrically insulating layer and a gate electrode layer are formed on such an emitter layer, the emitter layer is adhered to the electrically insulating layer through weak adhesive force, resulting in instability in a structure of a cold cathode. Furthermore, if an electrically insulating thin layer and a thin gate electrode layer are formed on a quite wavy emitter layer, the resultant electrically insulating layer would have a non-uniform thickness, causing a problem of device destruction due to insufficient electrical insulation.

In particular, a planar image-displaying apparatus including a plurality of emitters two-dimensionally arranged would have a problem that display characteristic is not uniform due to local dielectric breakdown, resulting in instability and non-uniformity in displayed images. It would be necessary for an electrically insulating layer to have a thickness of at least 4 micrometers, in order to ensure highly reliable performance.

Thus, a conventional method of fabricating a field emission type cold cathode including the steps of forming an electrically insulating layer and a gate electrode layer in this order on an emitter layer, and partially etching the electrically insulating layer and the gate electrode layer to form an opening therethrough, has limit in forming an electrically insulating layer thin for arranging a gate electrode and an emitter layer close to each other.

The second problem is a reduced efficiency in emission.

Electrons emitted from an emitter layer by means of an electrode such as a gate electrode layer and a grid enter not only an anode electrode, but also a gate electrode. Hereinbelow, an emission current entering an anode electrode is referred to as an anode current, and an emission current entering a gate electrode layer is referred to as a gate current. If a ratio (emission ratio) of a sum of an anode current and a gate current to an anode current is higher, there would be obtained more desired performance. For instance, since light emission is generated by bombarding electrons to an anode electrode, that is, a fluorescent screen in a planar apparatus for displaying image therein, a light-emission efficiency could be raised by bombarding much electrons to an anode electrode.

On the other hand, if a gate current is greater than an anode current, it would be necessary to flow an unnecessary current through a device, causing problems of an increase in power consumption and reduction in lifetime.

In the field emission type cold cathode illustrated in FIG. 15, since the grid 155 entirely covers therewith an opening formed throughout the first electrically conductive layer 154*a*, the electrically insulating layer 152 and the second electrically conductive layer 154*b*, most of emitted electrons enter the grid 155. As a result, an emission efficiency is quite low, specifically, 10% at greatest.

In the field emission type cold cathode illustrated in FIG. 16, since an opening formed throughout the gate electrode layer 161 has a diameter smaller than a diameter of an opening formed throughout the electrically insulating layer 162, electrons emitted from a portion of the emitter layer 163 located below the gate electrode layer 161 enter the gate electrode layer 161.

In the field emission type cold cathode illustrated in FIG. 17, since, an opening formed throughout the gate electrode layer 171 has a diameter equal to a diameter of an opening formed throughout the electrically insulating layer 172, the field emission type cold cathode could have a higher emission ratio than that of the field emission type cold cathode illustrated in FIG. 16.

However, a part of electrons emitted from a surface of the emitter layer 173 in the vicinity of an edge of the opening enter the gate electrode layer 171.

FIG. 18 additionally illustrates a profile of equipotential surfaces on a cross-section of the field emission type cold cathode illustrated in FIG. 17. The illustrated equipotential surfaces are calculated under the conditions that a voltage (anode voltage) of 2 kV is applied to the anode electrode 176, a voltage (gate voltage) of 40V relative to the emitter layer 173 is applied to the gate electrode layer 171, a distance between the anode electrode 176 and the emitter layer 173 is 2 mm, a diameter of the opening is 50 micrometers, and a thickness of the electrically insulating layer 172 is 10 micrometers. The anode and gate voltages are typical voltages to be applied in a planar apparatus for displaying images.

Under the above-mentioned conditions, an electric field generated between the anode electrode 176 and the emitter layer 173 has an intensity of 1 V/micrometer, and an electric field generated between the gate electrode layer 171 and the emitter layer 173 has an intensity of 4 V/micrometer.

Hence, the equipotential surfaces found in the opening tend to be projectional towards the anode electrode 176, and an electric field generated at an edge of the opening is about twice greater than an electric field generated at a center of the opening, in which case, emission from an area around an edge of the opening is predominant.

By virtue of the profile in which equipotential surfaces are projectional towards the anode electrode, electrons emitted from a surface of the emitter layer 173 in the vicinity of an edge of the opening tend to enter the gate electrode layer 171.

As mentioned above, even if the opening formed throughout the gate electrode layer 171 has a diameter equal to a diameter of the opening formed throughout the electrically insulating layer 172, emission electrons tend to the gate electrode layer 171, and hence, an emission efficiency is 50% at greatest.

When the gate electrode layer 171 and the emitter layer 173 are arranged close to each other, an emission efficiency is further reduced, because a difference in intensity between an electric field generated in the vicinity of an edge of the opening and an electric field generated in the vicinity of a center of the opening becomes greater.

Thus, it was quite difficult in a conventional field emission type cold cathode and a conventional apparatus for displaying images therein to accomplish both of reduction in a voltage to be applied and enhancement in an emission efficiency.

In view of the above-mentioned problems in the conventional field emission type cold cathodes, it is a first object of the present invention to provide a field emission type cold cathode which is capable of accomplishing reduction in a voltage to be applied regardless of a thickness of an electrically insulating layer, and further, it is a second object of the present invention to provide a field emission type cold cathode which is capable of ensuring a high emission efficiency, even if a voltage to be applied is lowered.

DISCLOSURE OF THE INVENTION

In order to accomplish the above-mentioned objects, the present invention provides a field emission type cold cathode including a substrate at least a surface of which is electrically conductive, an electrically insulating layer formed on the substrate and formed therethrough with a first opening, a gate electrode layer formed on the electrically insulating layer and formed therethrough with a second opening almost concentric with the first opening, the second opening having a diameter equal to or greater than a diameter of the first opening, and an emitter layer formed in the first opening, characterized in that the emitter layer is formed on a bottom and an inner sidewall of the first opening.

In the field emission type cold cathode in accordance with the present invention, the emitter layer is formed further on an inner sidewall of the first opening formed throughout the electrically insulating layer. Hence, it is possible to shorten a distance between the emitter layer and the gate electrode layer regardless of a thickness of the electrically insulating layer, ensuring reduction in a voltage to be applied.

In addition, by designing an opening formed throughout the gate electrode layer to have the second opening having a diameter greater than a diameter of the first opening formed throughout the electrically insulating layer, as mentioned later, it would be possible to prevent electrons emitted from the emitter layer from directing to the gate electrode layer, ensuring significant enhancement of an emission efficiency.

It is preferable that the second opening has such a diameter that a line connecting any point on the emitter layer to an edge of the second opening in a minimum distance intersects with the electrically insulating layer. In order to design the second opening to have such a diameter, a distance D between an edge of the first opening and the edge of the second opening is defined as $$D \geqq tg \times d/(2ti)$$

wherein "d" indicates a diameter of the first opening, "tg" indicates a thickness of the gate electrode layer, and "ti" indicates a vertical distance between the emitter layer and the gate electrode layer.

It is preferable that a height of the emitter layer formed on the inner sidewall of the first opening, as viewed from a bottom of the first opening, is lower than a line connecting a center of the emitter layer to an upper edge of the second opening.

It is preferable that a height of the emitter layer formed on the inner sidewall of the first opening, as viewed from a bottom of the first opening, is higher towards the inner sidewall of the first opening.

The present invention further provides a field emission type cold cathode including a substrate at least a surface of which is electrically conductive, an electrically insulating layer formed on the substrate and formed therethrough with a first opening, a gate electrode layer formed on the electrically insulating layer and formed therethrough with a second opening almost concentric with the first opening, the second opening having a diameter equal to or greater than a diameter of the first opening, and an emitter layer formed in the first opening, characterized in that the emitter layer has a thickness, measured from a bottom of the first opening, greater towards the inner sidewall of the first opening.

For instance, the emitter layer has an arcuate cross-section.

It is preferable that an edge of the second opening formed throughout the gate electrode layer is set back relative to an edge of the first opening.

It is preferable that the field emission type cold cathode further includes a second electrically insulating layer formed on the electrically insulating layer and within the second opening, in which case, it is preferable that the second electrically insulating layer has a thickness greater than a thickness of the gate electrode layer.

It is preferable that a height of the emitter layer formed on the inner sidewall of the first opening, as viewed from a bottom of the first opening, is smaller than the electrically insulating layer.

For instance, the emitter layer is comprised of carbon nano-tubes.

It is preferable that the electrically insulating layer has a thickness equal to or greater than 4 micrometers.

It is preferable that the emitter layer is formed all over the substrate.

The present invention further provides a method of fabricating a field emission type cold cathode, including a first step of forming an electrically insulating layer and a gate electrode layer in this order on a substrate at least a surface of which is electrically conductive, a second step of partially removing the gate electrode layer and the electrically insulating layer such that the electrically insulating layer is formed therethrough with a first opening and the gate electrode layer is formed therethrough with a second opening almost concentric with the first opening and having a diameter equal to or greater than a diameter of the first opening, a third step of forming a mask on the gate electrode layer which mask is formed with a third opening above the first opening, and a fourth step of depositing a material of which an emitter layer is composed, in the first opening through the mask to form an emitter layer on a bottom and an inner sidewall of the first opening.

It is preferable that the second opening has such a diameter that a line connecting any point on the emitter layer to an edge of the second opening in a minimum distance intersects with the electrically insulating layer. In order to design the second opening to have such a diameter, a distance D between an edge of the first opening and the edge of the second opening is defined as $$D \geqq tg \times d/(2ti)$$

wherein "d" indicates a diameter of the first opening, "tg" indicates a thickness of the gate electrode layer, and "ti" indicates a vertical distance between the emitter layer and the gate electrode layer.

It is preferable that the emitter formed on the inner sidewall of the first opening in the fourth step has a height as viewed from a bottom of the first opening, lower than a line connecting a center of the emitter layer to an upper edge of the second opening.

It is preferable that the emitter formed on the inner sidewall of the first opening in the fourth step has a height higher towards the inner sidewall of the first opening.

For instance, the mask is comprised of a metal mask. As an alternative, the mask may be composed of dry film resist.

It is preferable that the third opening is smaller in area than the first opening, and an edge of the first opening is covered with the mask.

The material of which the emitter layer is composed may be deposited in the fourth step by spraying. As an alternative the material may be deposited by screen-printing, chemical vapor deposition or sputtering.

It is preferable that the material of which the emitter layer is composed is deposited in the fourth step obliquely in an angle in the range of 15 to 45 degrees both inclusive relative to a normal line vertically extending from the substrate with the substrate being rotated.

It is preferable that the method further includes a fifth step of, after the emitter layer has been formed, removing an edge of the emitter layer formed on the inner sidewall of the first opening.

The fifth step may be carried out by adhering an adhesive tape to the edge of the emitter layer and peeling off the adhesive tape, rubbing, etching, or a combination of etching, and adhering an adhesive tape to the edge of the emitter layer and peeling off the adhesive tape.

The present invention further provides a method of fabricating a field emission type cold cathode, including a first step of forming an electrically insulating layer and a gate electrode layer in this order on a substrate at least a surface of which is electrically conductive, a second step of partially removing the gate electrode layer and the electrically insulating layer such that the electrically insulating layer is formed therethrough with a first opening and the gate electrode layer is formed therethrough with a second opening almost concentric with the first opening and having a diameter equal to or greater than a diameter of the first opening, a third step of at least partially filling the first opening with a material of which an emitter layer is composed, to form an emitter layer in the first opening which emitter layer covers at least a bottom of the first opening therewith.

For instance, the emitter layer is formed to have an arcuate cross-section.

It is preferable that the second opening is formed throughout the gate electrode layer in the second step such that an edge thereof is set back relative to an edge of the first opening.

The method may further include a step of forming a second electrically insulating layer on the electrically insulating layer and within the second opening.

It is preferable that the second electrically insulating layer is formed to have a thickness greater than a thickness of the gate electrode layer.

It is preferable that the emitter layer is formed in the fourth step such that a height of the emitter layer formed on the inner sidewall of the first opening, as viewed from a bottom of the first opening, is smaller than the electrically insulating layer.

The first and second openings may be formed in common photolithography.

The present invention further provides a method of fabricating a field emission type cold cathode, including a first step of forming a first electrically insulating layer and a gate electrode layer in this order on a substrate at least a surface of which is electrically conductive, a second step of patterning the gate electrode layer to have an opening, a third step of forming a second electrically insulating layer covering the first electrically insulating layer and the gate electrode layer therewith, a fourth step of partially removing the first electrically insulating layer and the second electrically insulating layer such that the first and second electrically insulating layers are formed therethrough with a second opening almost concentric with the opening of the gate electrode layer and having a diameter equal to or smaller than a diameter of the opening of the gate electrode layer, and a fifth step of forming an emitter layer in the second opening.

The present invention further provides a planar apparatus for displaying images therein, including the above-mentioned field emission type cold cathode, and a substrate arranged facing the field emission type cold cathode, and including RGB phosphors coated thereon.

The present invention further provides a method of fabricating a planar apparatus for displaying images therein, including the steps of fabricating a field emission type cold cathode in accordance with the above-mentioned method, fabricating a substrate on which RGB phosphors are coated, and facing the field emission type cold cathode and the substrate each other with a space therebetween being made vacuous.

DESCRIPTION OF THE PREFERRED EMBODIMENTS

Preferred embodiments in accordance with the present invention will be explained hereinbelow with reference to drawings.

First Embodiment

Figure 1:
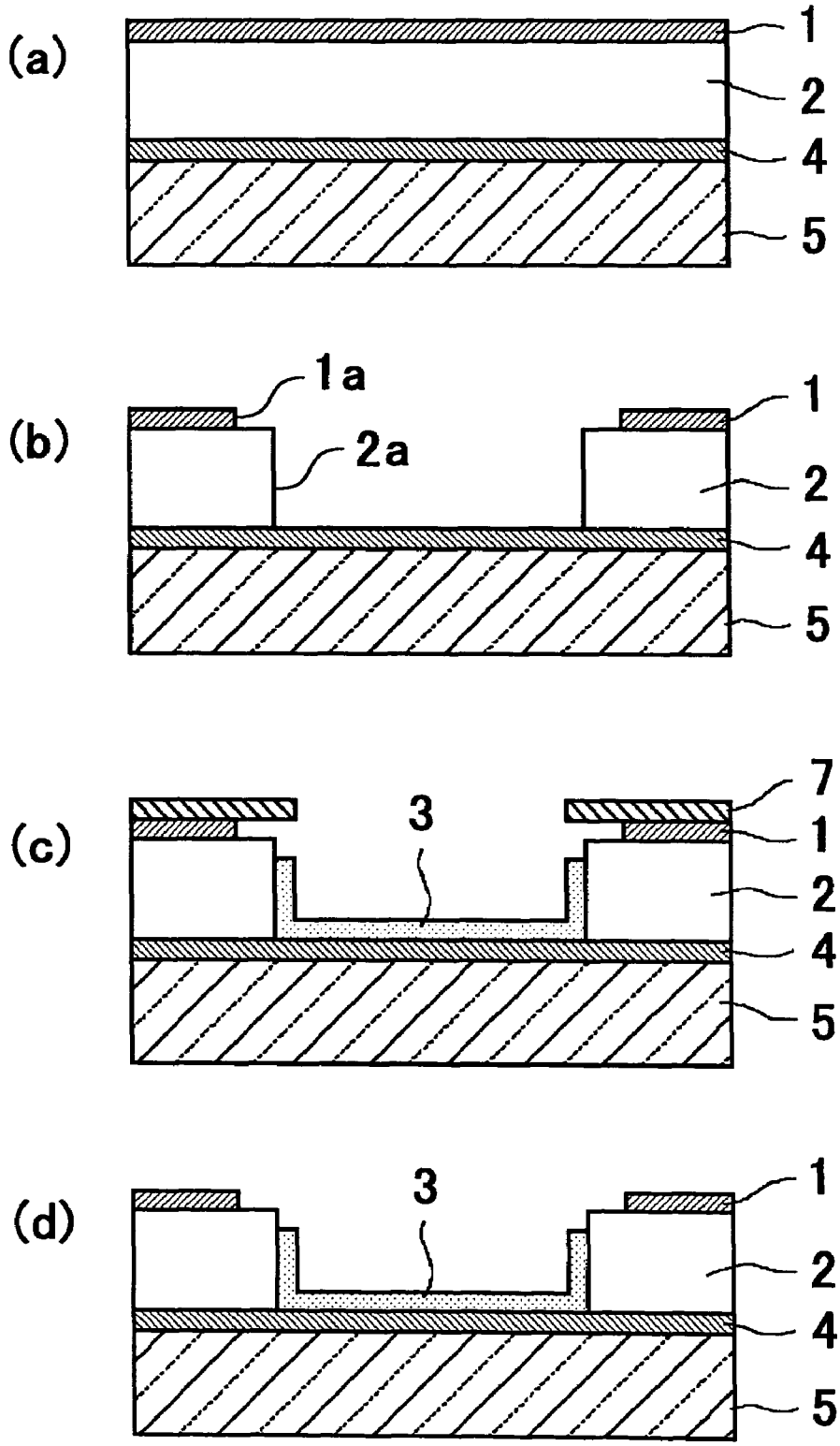
FIG. 1 is a cross-sectional view illustrating respective steps in an order in a method of fabricating a field emission type cold cathode in accordance with the first embodiment of the present invention.

FIG. 1 is a cross-sectional view of a field emission type cold cathode, illustrating respective steps in an order in a method of fabricating a field emission type cold cathode in accordance with the first embodiment of the present invention.

As illustrated in FIG. 1(*a*), as a substrate on which an emitter is to be fabricated, there is used a glass substrate 5 on which an electrically conductive layer 4 is formed. For instance, the electrically conductive layer 4 is comprised of an aluminum layer having a thickness of 0.5 micrometers.

In place of the glass substrate 5, an electrically conductive substrate may be used. At any rate, any substrate may be used, if it has an electrically conductive surface.

Then, an electrically insulating layer 2 comprised of a silicon oxide film or a polyimide film and having a thickness of 4 micrometers is formed on the electrically conductive layer 4. Then, on the electrically insulating layer 2 is formed an aluminum layer having a thickness of 0.5 micrometers as a gate electrode layer 1.

Then, as illustrated in FIG. 1(*b*), the gate electrode layer 1 and the electrically insulating layer 2 are partially etched to thereby form openings 1*a* and 2*a* throughout the gate electrode layer 1 and the electrically insulating layer 2, respectively.

The opening 1*a* is formed throughout the gate electrode layer 1 to have a diameter greater than a diameter of the opening 2*a* formed throughout the electrically insulating layer 2. Specifically, the opening 1*a* is formed throughout the gate electrode layer 1 to have such a diameter that a line connecting any point on a later mentioned emitter layer 3 formed in the opening 2*a* to an edge of the opening 1*a* in a minimum distance intersects with the electrically insulating layer 2. In the first embodiment, in order to meet with such a condition, the opening 1*a* is formed throughout the gate electrode layer 1 is designed to have a diameter of 60 micrometers, and the opening 2*a* formed throughout the electrically insulating layer 2 is designed to have a diameter of 50 micrometers.

The openings 1*a* and 2*a* can be formed in separate photolithography, but can be formed in single photolithography by side etching of the gate electrode layer 1 (see later mentioned FIGS. 7 and 8).

Then, as illustrated in FIG. 1(*c*), the electrically insulating layer 2 is covered with a mask 7 having an opening corresponding to the opening 2*a* formed throughout the electrically insulating layer 2.

The opening of the mask 7 is smaller in area than the opening 2*a* such that an edge of the opening 2*a* is completely covered with the mask 7.

Then, carbon nano-tube is deposited on a bottom and an inner sidewall of the opening 2*a* by a thickness of about 1.5 micrometers by spraying or screen-printing, to thereby form an emitter layer 3.

As illustrated in FIG. 1(*c*), the emitter layer 3 is formed in a uniform thickness on a bottom and an inner sidewall of the opening 2*a* formed throughout the electrically insulating layer 2.

After the formation of the emitter layer 3, the mask 7 is removed, as illustrated in FIG. 1(*d*).

Diameters of the openings 1*a* and 2*a* are determined as follows.

Figure 2:
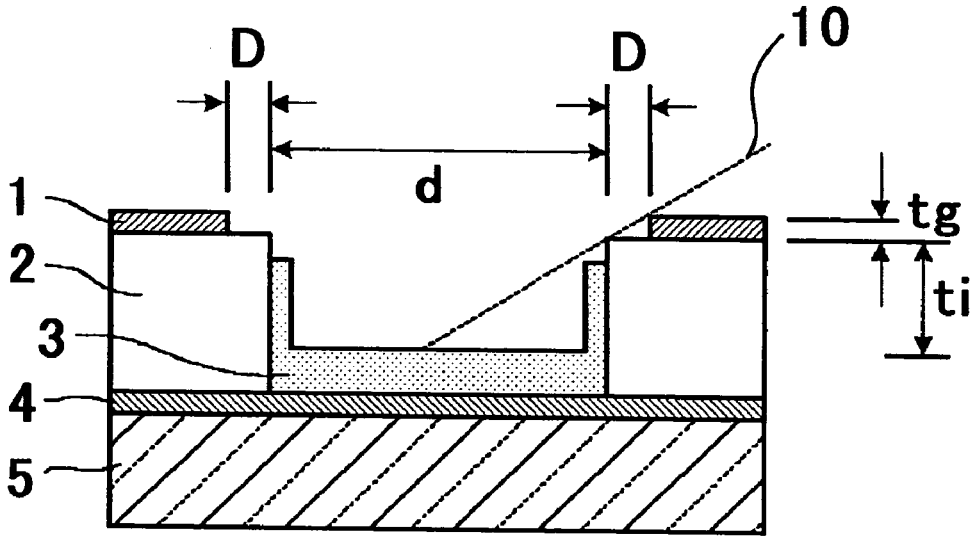
FIG. 2 is a cross-sectional view of a field emission type cold cathode in accordance with the first embodiment of the present invention.

As illustrated in FIG. 2, in order for a line connecting any point on the emitter layer 3 to an edge of the opening 1*a* closest to the emitter layer 3, in a minimum distance to intersect with the electrically insulating layer 2, a distance D between an edge of the opening 2*a* and an edge of the opening 1*a* is determined in accordance with the following inequality:

$$D \geqq tg \times d/(2ti)$$

wherein "d" indicates a diameter of the opening 2*a* formed throughout the electrically insulating layer 2, "tg" indicates a thickness of the gate electrode layer 1, and "ti" indicates a relative vertical distance between the emitter layer 3 and the gate electrode layer 1.

Figure 3:
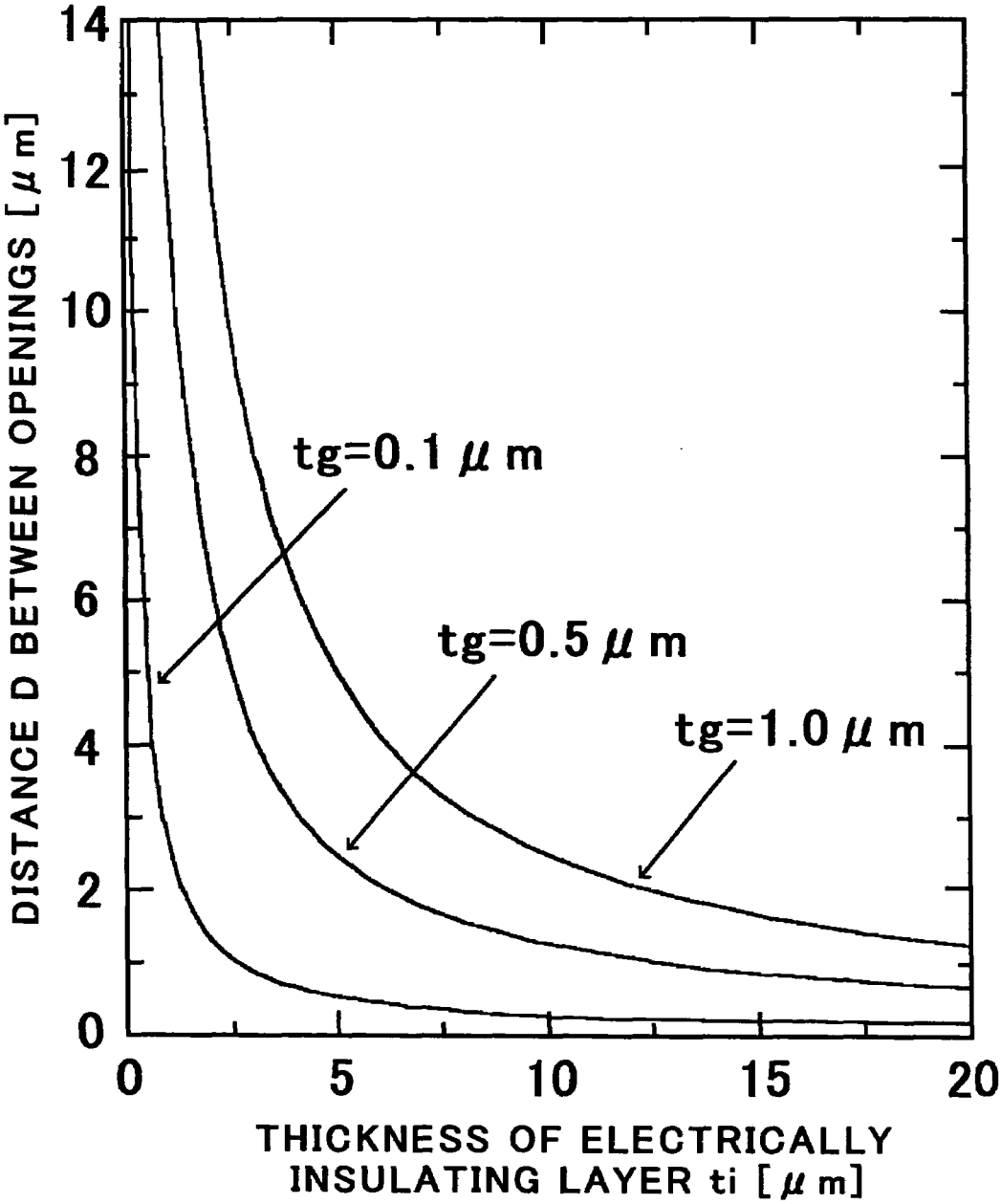
FIG. 3 is a graph showing dependency of a distance between an edge of an opening formed throughout an electrically insulating layer and an edge of an opening formed throughout a gate electrode layer, on a thickness of the electrically insulating layer in a field emission type cold cathode in accordance with the first embodiment of the present invention.

FIG. 3 is a graph showing the dependency of the distance D on the thickness "ti" of the electrically insulating layer 2 in the case that the diameter "d" of the opening 2*a* is 50 micrometers and the thickness "tg" of the gate electrode layer 1 is 0.1, 0.5 or 1.0 micrometer.

In accordance with the graph, when the thickness "tg" of the gate electrode layer 1 is 0.5 micrometers and the thickness "ti" of the electrically insulating layer 2 is 2.5 micrometers, the distance D is equal to or greater than about 5 micrometers, resulting in that a diameter of the opening 1*a* is 60 micrometers, as mentioned earlier.

As illustrated in FIG. 2, by depositing carbon nano-tube to have a height lower than a line 10 (broken line) connecting a center of the emitter layer 3 to an upper edge of the opening 1*a* through an edge of the opening 2*a*, a line connecting any point on the emitter layer 3 to an edge of the opening 1*a*, closest to the point, in a minimum distance intersects with the electrically insulating layer 2.

A vertical thickness of the emitter layer 3 formed on an inner sidewall of the electrically insulating layer 2 is determined so that the vertical thickness does not interfere with the line 10 illustrated in FIG. 2.

The mask 7 may be formed by spin-coating liquid resist, exposing the resist to light, and developing the resist to partially the electrically insulating layer 2 for forming the opening 2*a*.

Thus, in the first embodiment, there is used a metal mask which is capable of simplifying a process of fabricating a cold cathode, and exerts only small influence on the emitter layer 3 composed of a carbon nano-tube film, when the mask 7 is removed.

However, if diameters of the first and second openings 1*a* and 2*a* are equal to or smaller than 30 micrometers, for instance, it would be difficult to fabricate a metal mask, and hence, it would be necessary to use resist as the mask. When resist is used as the mask, it is preferable to select dry film resist in order to form an opening of the mask 7 to be smaller than the opening 2*a* formed throughout the electrically insulating layer 2.

When the emitter layer 3 is formed by spraying carbon nano-tube, even if carbon nano-tube is sprayed onto the substrate 5 vertically from above, it would be possible to adhere carbon nano-tube onto an inner sidewall of the opening 2*a* by virtue of expansion and/or rebound of sprayed particles.

The emitter layer 3 can be formed uniformly and controllably onto an inner sidewall of the opening 2*a* by inclining the substrate 5 in the range of 15 to 45 degrees relative to a normal line of the substrate 5, and spraying carbon nano-tube onto the substrate 5 while the substrate 5 kept inclined is being rotated.

If carbon nano-tube is sprayed onto the substrate 5 with the substrate 5 being inclined in an angle equal to or smaller than 15 degrees, carbon nano-tube can be deposited onto an inner sidewall of the opening 2*a*, but non-uniformly and in scattered condition. As a result, a carbon nano-tube layer formed on an inner sidewall of the opening 2*a* cannot has sufficient electrical conductivity with the electrical conductive layer 4 and a carbon nano-tube layer formed on a bottom of the opening 2*a*.

In contrast, if carbon nano-tube is sprayed onto the substrate 5 with the substrate 5 being inclined in an angle equal to or greater than 45 degrees, since the opening 2*a* has a diameter greater than a diameter of the opening 1*a*, carbon nano-tube is likely to enter a gap formed between the mask 7 and the gate electrode layer 1, causing short-circuit between the gate electrode layer 1 and the emitter layer 3.

A thickness of a carbon nano-tube layer formed on an inner sidewall of the opening 2*a* formed throughout the electrically insulating layer 2 can be controlled by controlling a diameter of an opening of the metal mask 7 and an incident angle of sprayed particles.

For instance, in order to reduce a thickness of a carbon nano-tube layer formed on an inner sidewall of the opening 2*a* formed throughout the electrically insulating layer 2, a rate at which carbon nano-tube particles are deposited onto an inner sidewall of the opening 2*a* may be reduced, for instance, by designing a diameter of an opening of the mask 7 to be small or setting an incident angle of sprayed particles to be small.

Carbon nano-tube is grouped into single-layer carbon nano-tube and multi-layer carbon nano-tube. Any one of them may be used. In the first embodiment, there is used single-layer carbon nano-tube fabricated by an arc-discharging process.

A reaction chamber is filled with helium gas having a pressure of $6.7\times10^4$ Pa, and two carbon rods containing catalyst metal therein are made to face each other. Then, arc discharge is generated between the two carbon rods. As a result, solid material containing carbon nano-tube therein is deposited on both of surfaces of the anode carbon rods and an inner wall of the reaction chamber. Arc discharge is generated by applying a voltage of 18V across the two carbon rods to thereby cause a current of 100 A to run therethrough.

The resultant solid material contains not only carbon nano-tubes, but also particles having a diameter in the range of about 10 to about 100 nanometers, such as graphite, amorphous carbon and catalyst metal.

The thus obtained carbon nano-tube is single-layer nano-tube, and has a diameter in the range of about 1 to 5 nanometers, a length in the range of 0.5 to 100 micrometers, and an average length in the range of about 2 micrometers.

The above-mentioned crude material is suspended in ethyl alcohol, and crushed with supersonic-waves.

Then, the solid suspension is filtered through a membrane filter having a pore size of 0.22 micrometers. Since impurity particles other than carbon nano-tube is smaller than the pore size of the membrane filter, they pass through the membrane filter, but carbon nano-tube having a length of 0.5 micrometers or longer remains on the membrane filter. The carbon nano-tube remaining on the membrane filter is extracted. Thus, only carbon nano-tube can be collected.

Carbon nano-tube can be purified in accordance with a method suggested in Japanese Patent Application Publication No. 8-231210, for instance. By carrying out the method, highly purified carbon nano-tube can be obtained.

In the first embodiment, carbon nano-tube is crushed into pieces having a length of 10 micrometers or smaller in order to form a flat and uniform film. Since the thus obtained highly purified and crushed carbon nano-tube is scattered in ethyl alcohol by supersonic-waves, solution in which carbon nano-tube is scattered may be used.

In the first embodiment, in order to enhance an adhesive force between carbon nano-tube and the substrate 5, carbon nano-tube is scattered in binder such as nitrocellulose or acryl, and the resultant solution is used for forming the emitter layer 3 comprised of a carbon nano-tube film.

In the field emission type cold cathode in accordance with the first embodiment, electrons emitted from the emitter layer 3 are not likely to fly directly into the gate electrode layer 1, because a line connecting any point on the emitter layer 3 to an edge of the opening 1*a* closest to the point, in a minimum distance is designed to intersect with the electrically insulating layer 2.

In addition, if a part of the emitted electrons bombard to an inner sidewall of the opening 2*a* of the electrically insulating layer 2, an area in which the emitted electrons bombard is charged up to a negative voltage, and hence, orbits through which the emitted electrons fly are concentrated to a center of the opening 2*a*, improving convergence of electron beams.

Figure 18:
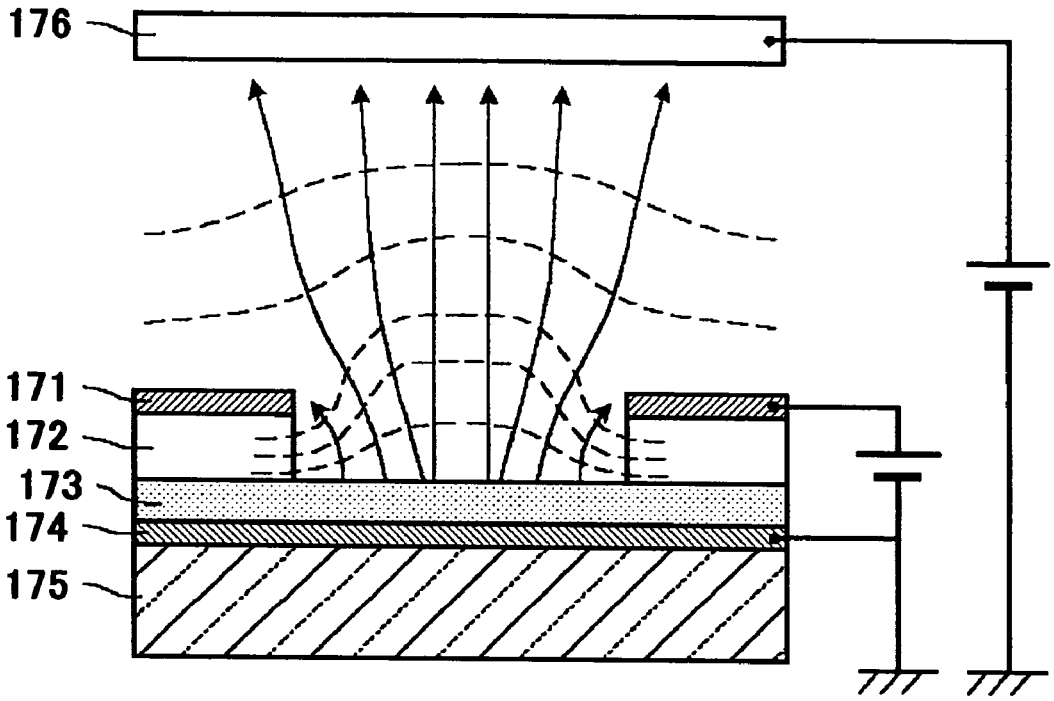
FIG. 18 is a cross-sectional view of a third conventional field emission type cold cathode for explaining an operation thereof.

The emitter layer 3 formed on an inner sidewall of the opening 2*a* sharply vertically projects from the substrate 5. As illustrated in FIG. 18, since equipotential surfaces in the openings generally have a projectional voltage profile, a more intensive electric field is applied to an edge of the opening 2*a* than a center of the opening 2*a*. In addition, since equipotential surfaces are capable of penetrating the electrically insulating layer 2, there is generated remarkably high electric field concentration above the emitter layer 3 sharply projecting in the form of a cup along an inner sidewall of the opening.

Figure 4:
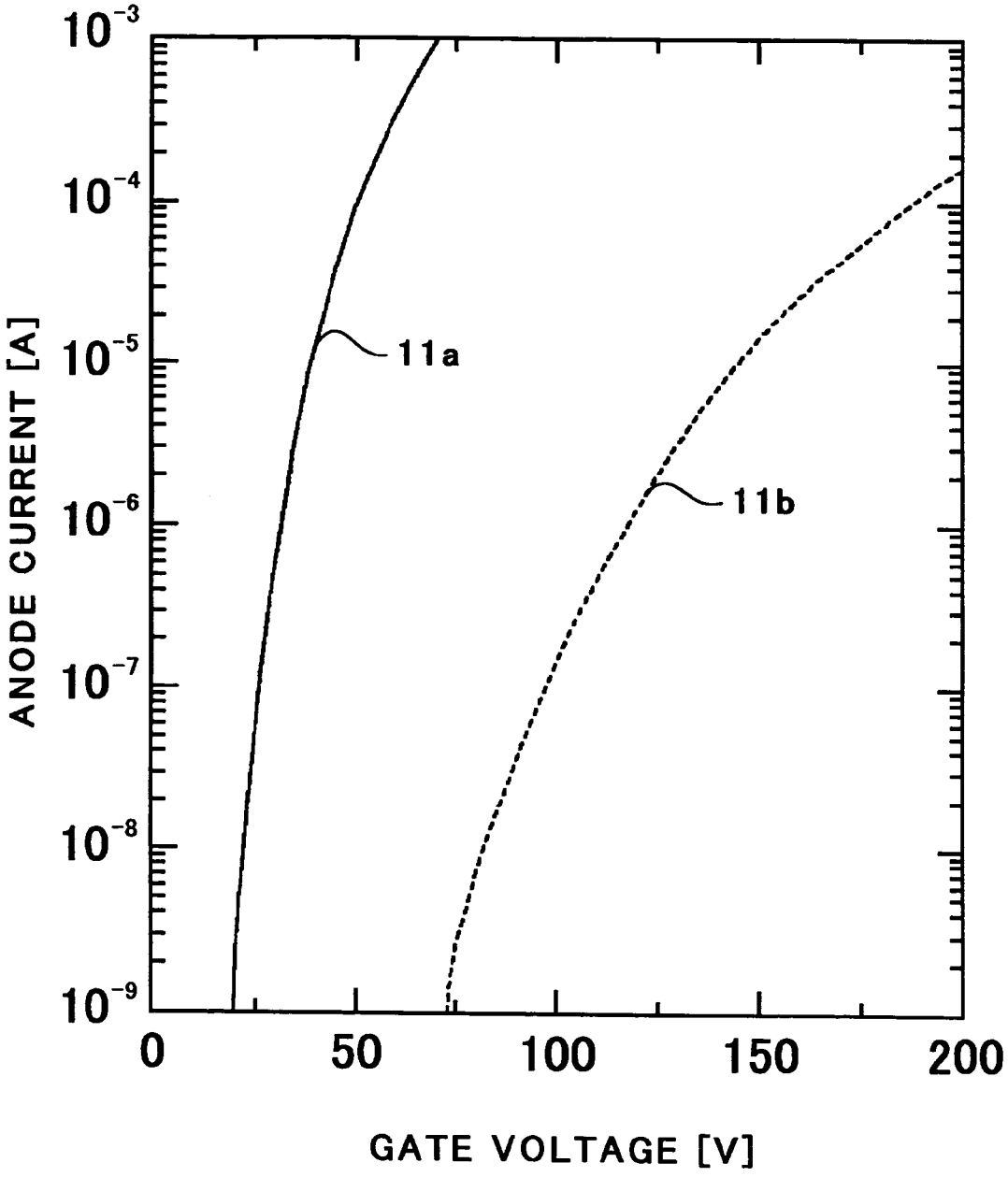
FIG. 4 is a graph showing dependency of an emission current on an applied voltage in a field emission type cold cathode in accordance with the first embodiment of the present invention.

The solid line 11*a* in FIG. 4 shows dependency of an emission current on a gate voltage in a field emission type cold cathode in accordance with the first embodiment.

The field emission type cold cathode has the same structure as that of the above-mentioned one except that the field emission type cold cathode has 3600 openings. A distance between an anode electrode and an emitter layer is 2 mm, and an anode voltage is 2 kV.

The broken line 11*b* in FIG. 4 shows dependency of an emission current on a gate voltage in a conventional field emission type cold cathode in which an opening formed throughout a gate electrode layer has a diameter equal to a diameter of an opening formed throughout an electrically insulating layer, and carbon nano-tube is not formed on an inner sidewall of an opening.

The field emission type cold cathode in accordance with the first embodiment has a greater emission current and operates at a lower voltage relative to a conventional field emission type cold cathode.

For instance, whereas an emission efficiency obtained when an emission current of 0.1 mA is produced is about 32% in a conventional field emission type cold cathode, the same is about 99% in the field emission type cold cathode in accordance with the first embodiment. The field emission type cold cathode in accordance with the first embodiment can accomplish a remarkably high emission efficiency.

As having been explained so far, it is possible to concentrate electric field to a summit of the emitter layer 3 by forming the emitter layer 3 further on an inner sidewall of the opening 2*a* formed throughout the electrically insulating layer 2 arranged close to the gate electrode layer 1, and thus, it is possible to drive a field emission type cold cathode at a low voltage.

Furthermore, it is possible to prevent electrons emitted from the emitter layer 3 from directly entering the gate electrode layer 1 by forming the openings 1*a* and 2*a* such that a line connecting any point on the emitter layer 3 to an edge of the opening 1*a* closest to the point is designed to intersect with the electrically insulating layer 2, and resultingly, it is also possible to reduce a gate current, and enhance an emission efficiency.

In addition, since electrons bombarding to an inner sidewall of the opening 2*a* of the electrically insulating layer 2 are charged up to a negative voltage, orbits through which the emitted electrons fly are converged, further improving an emission efficiency.

Second Embodiment

Figure 5:
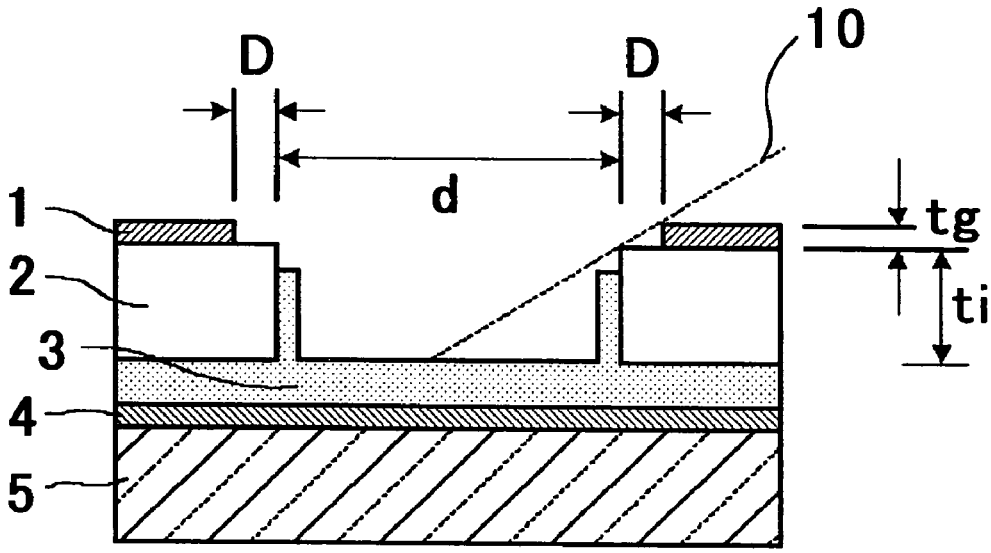
FIG. 5 is a cross-sectional view of a field emission type cold cathode in accordance with the second embodiment of the present invention.

FIG. 5 is a cross-sectional view of a field emission type cold cathode in accordance with the second embodiment.

In the field emission type cold cathode in accordance with the above-mentioned first embodiment, the emitter layer 3 comprised of a carbon nano-tube layer is formed on a bottom and a sidewall of the opening 2*a* after the openings 1*a* and 2*a* have been formed throughout the gate electrode layer 1 and the electrically insulating layer 2, respectively.

In the second embodiment, as illustrated in FIG. 5, carbon nano-tube is first deposited on the electrically conductive layer 4, and then, the emitter layer 3, the electrically insulating layer 2 and the gate electrode layer 1 are formed. Then, the openings 1*a* and 2*a* are formed. Thereafter, the emitter layer 3 is formed also on an inner sidewall of the opening 2*a* in the same way as the first embodiment.

As mentioned above, it is necessary for the electrically insulating layer 2 to have a thickness of 4 micrometers or greater in order to solve problems of an adhesive force between carbon nano-tube and the electrically insulating layer 2, non-uniformity of a thickness of the electrically insulating layer 2, and dielectric breakage of the electrically insulating layer 2.

Even if the electrically insulating layer 2 is extremely thick, it would be possible to design a relative small distance between the gate electrode layer 1 and the emitter layer 3 by depositing carbon nano-tube on an inner sidewall of the opening 2*a*.

Accordingly, the field emission type cold cathode in accordance with the second embodiment can be driven at a low voltage, and present a high efficiency without deterioration in electrical insulating characteristic and lifetime.

Third Embodiment

Figure 6:
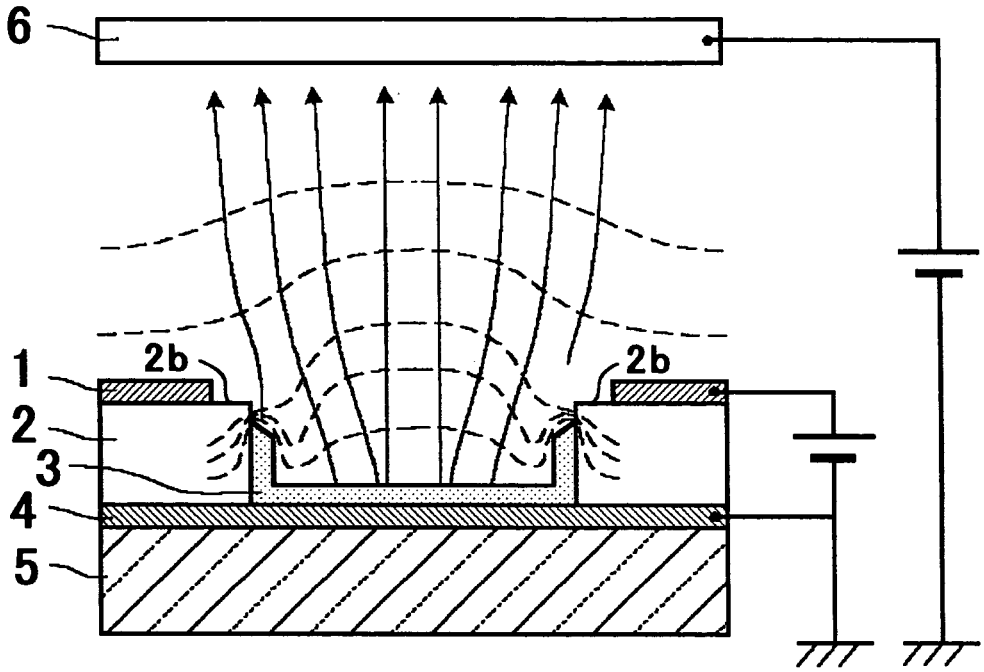
FIG. 6 is a cross-sectional view of a field emission type cold cathode in accordance with the third embodiment of the present invention.

FIG. 6 is a cross-sectional view of a field emission type cold cathode in accordance with the third embodiment.

In the field emission type cold cathode in accordance with the third embodiment, a vertical thickness of the emitter layer 3 formed on an inner sidewall of the opening 2*a* is designed to increase towards an edge of the opening 2*a* from a center of the opening 2*a*. As a result, the emitter layer 3 has an acute-angled summit, that is, is sharpened at a summit thereof.

The field emission type cold cathode in accordance with the third embodiment, illustrated in FIG. 6, can be fabricated by carrying out the steps illustrated in FIGS. 1(*a*)-(*d*), and then, partially removing carbon nano-tube by means of an adhesive sheet. When an adhesive sheet is adhered to a surface of the field emission type cold cathode, the adhesive sheet is more curved in the vicinity of a center of the opening 2*a* than at an edge of the opening 2*a*. Hence, when the adhesive sheet is peeled off, carbon nano-tube is removed reflecting a curved shape of the adhesive sheet. That is, there is obtained the emitter layer 3 having such a sharpened summit as illustrated in FIG. 6.

Removal of the carbon nano-tube by means of an adhesive sheet aligns the carbon nano-tube existing in the opening 2*a* vertically to the substrate 5. Hence, an electric field is likely to be concentrated to ends of carbon nano-tubes, ensuring enhancement in emission characteristic.

In addition, when carbon nano-tube is partially removed by means of an adhesive sheet, carbon nano-tubes accidentally adhered to a ring-shaped surface 2*b* of the electrically insulating layer 2 formed due to a difference in diameter between the openings 2*a* and 1*a*, and particles adhered to the surface 2*b* during a process are removed, ensuring enhancement in electrical insulation between the gate electrode layer 1 and the emitter layer 3.

The above-mentioned merits can be obtained by rubbing, for instance, as well as by removal with an adhesive sheet.

A vertical height of the emitter layer 3 formed on an inner sidewall of the opening 2*a* can be greater at a location closer to the inner sidewall of the opening 2*a* further by dry etching.

Specifically, after fabrication of an intermediate product illustrated in FIG. 1(*c*), the substrate 5 is rotated with the substrate 5 being kept inclined. Then, by carrying out irradiation of collected ion beams or sputtering, for instance, it is possible to remove an upper edge of the emitter layer 3. After removal of an edge of the emitter layer by dry etching, alignment of the carbon nano-tube may be enhanced by adhering an adhesive tape to and peeling the adhesive tape off the carbon nano-tube.

Fourth Embodiment

Figure 7:
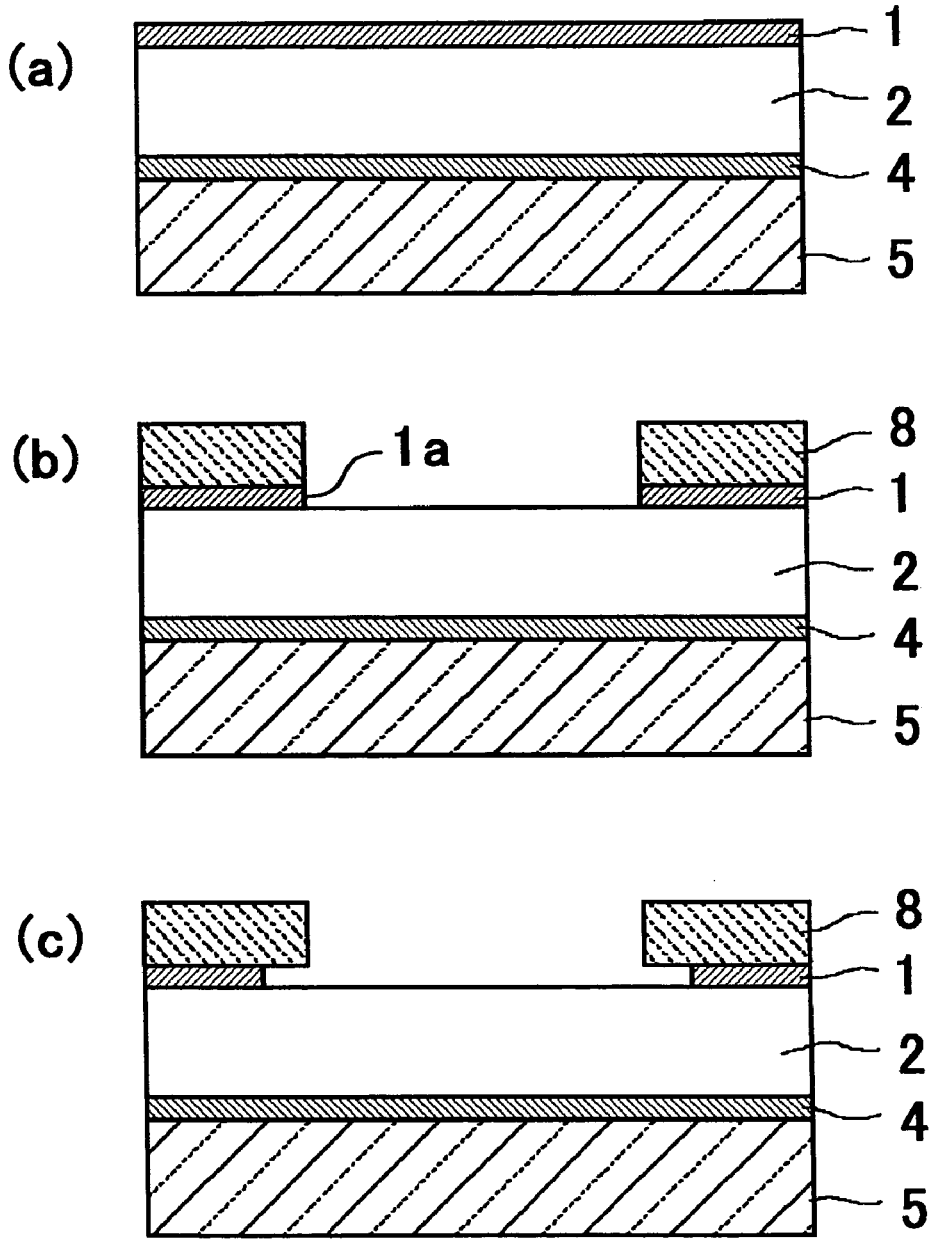
FIG. 7 is a cross-sectional view illustrating respective steps in an order in a method of fabricating a field emission type cold cathode in accordance with the fourth embodiment of the present invention.
Figure 8:
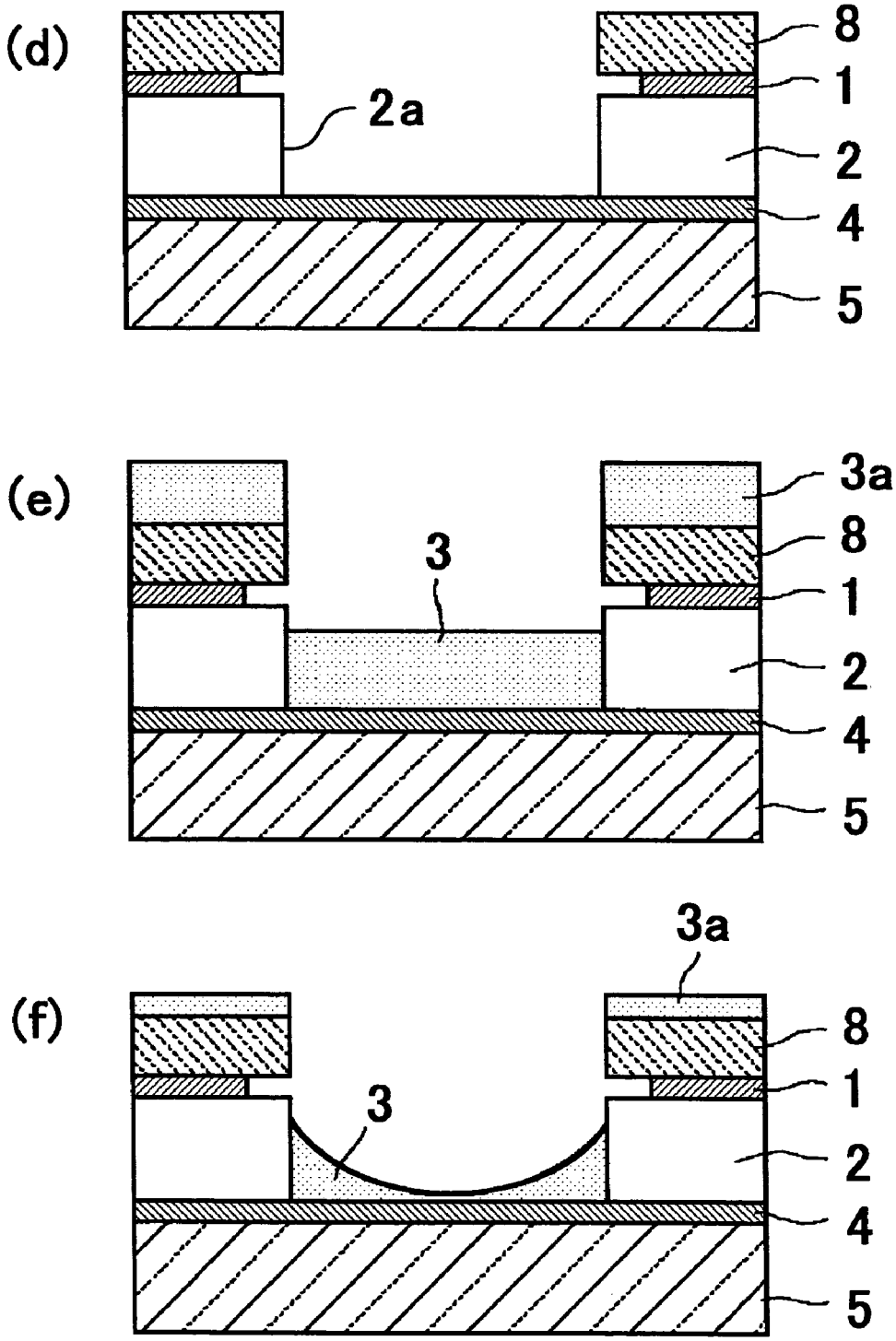
FIG. 8 is a cross-sectional view illustrating respective steps in an order in a method of fabricating a field emission type cold cathode in accordance with the fourth embodiment of the present invention.

FIGS. 7 and 8 are cross-sectional views illustrating respective steps in an order in a method of fabricating a field emission type cold cathode in accordance with the fourth embodiment of the present invention.

As illustrated in FIG. 7(*a*), as a substrate on which an emitter is to be fabricated, there is used a glass substrate 5 on which an electrically conductive layer 4 is formed. For instance, the electrically conductive layer 4 is comprised of an aluminum layer having a thickness of 0.5 micrometers.

In place of the glass substrate 5, an electrically conductive substrate may be used. Any substrate may be used, if it has at least an electrically conductive surface.

Then, an electrically insulating layer 2 comprised of a silicon oxide film or a polyimide film and having a thickness of 5 micrometers is formed on the electrically conductive layer 4. Then, on the electrically insulating layer 2 is formed an aluminum layer having a thickness of 0.5 micrometers as a gate electrode layer 1.

Then, on the gate electrode layer 1 is formed a resist film 8 having a pattern for forming an opening 2*a* throughout the electrically insulating layer 2. Then, as illustrated in FIG. 7(*b*), the gate electrode layer 1 is etched by wet or dry etching to form an opening 1*a* with the resist film 8 being used as a mask.

Then, the gate electrode layer 1 is side-etched by wet etching to thereby outwardly extend an edge of the opening 1*a* by about 5 micrometers, that is, a radius of the opening 1*a* is extended by about 5 micrometers, as illustrated in FIG. 7(*c*).

Then, as illustrated in FIG. 8(*d*), the electrically insulating layer 2 is etched by anisotropic etching to thereby form the opening 2*a* with the resist film 8 being used as a mask.

Then, as illustrated in FIG. 8(*e*), carbon nano-tube is sprayed for deposition to have a thickness of about 4.5 micrometers in the opening 2*a*. Thus, an emitter layer 3 is formed in the opening 2*a*, and a carbon nano-tube layer 3*a* is formed on the resist film 8.

Then, the substrate 5 above which the resist film 8 is formed is rotated while being kept inclined by about 20 degrees, and focused ion beams are irradiated onto the substrate 5 such that the emitter 3 has a recessed surface, as illustrated in FIG. 8(*f*).

Thereafter, the resist film 8 is peeled off for removal. The carbon nano-tube layer 3*a* is also removed when the resist film 8 is removed.

The emitter layer 3 may be etched at its surface by sputtering or RIE.

As having been explained in the third embodiment, the emitter layer 3 may be sharpened by means of an adhesive tape or by rubbing.

After the emitter layer 3 has been etched at its surface by dry etching, alignment of carbon nano-tubes may be enhanced by adhering an adhesive tape to and peeling the adhesive tape off the emitter layer.

Figure 9:
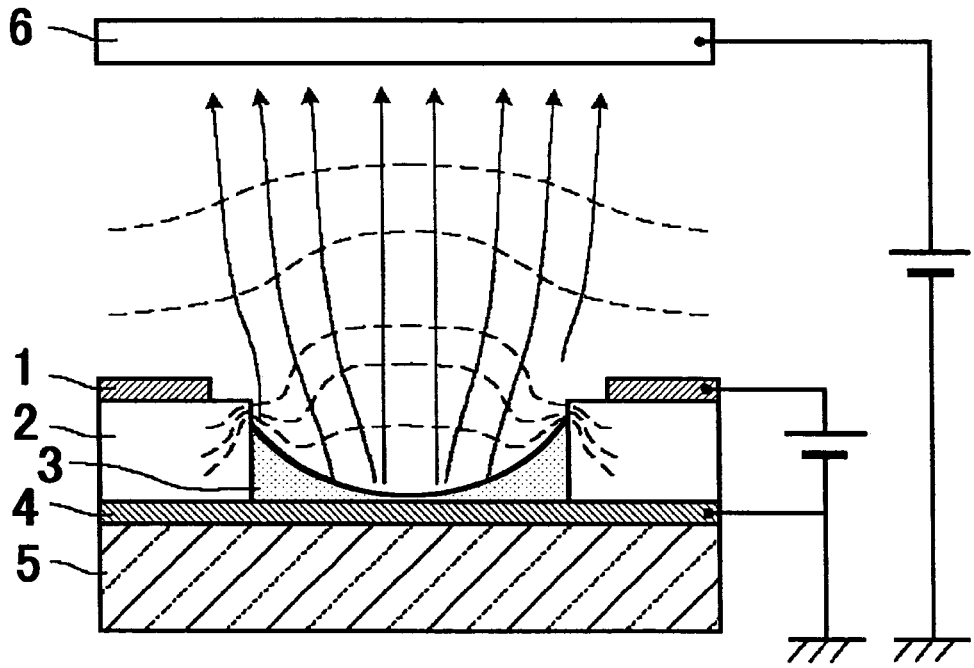
FIG. 9 is a cross-sectional view of a field emission type cold cathode in accordance with the fourth embodiment of the present invention.

FIG. 9 is a cross-sectional view of the thus fabricated field emission type cold cathode in accordance with the fourth embodiment.

As illustrated in FIG. 9, the emitter layer 3 has a vertical thickness which is greater at a location closer to an edge of the opening 2*a*. Thus, the emitter layer 3 in the fourth embodiment has a sharpened structure in comparison with the emitter layer 3 formed on an inner sidewall of the opening 2*a* illustrated in FIG. 1(*c*).

As mentioned above, an electric field generated in the opening 2*a* has a greater intensity at a location closer to an edge of the opening 2*a*, and hence, a more intensive electric field can be applied to a summit of the emitter layer 3 having a sharpened edge.

As is understood in view of equipotential surfaces illustrated in FIG. 9, the field emission type cold cathode in accordance with the fourth embodiment provides an advantage that electron beams are prevented from expanding, because a projectional profile of the equipotential surfaces is relaxed by a recessed surface of the emitter layer 3, and hence, a planarized voltage profile is generated.

Fifth Embodiment

Figure 10:
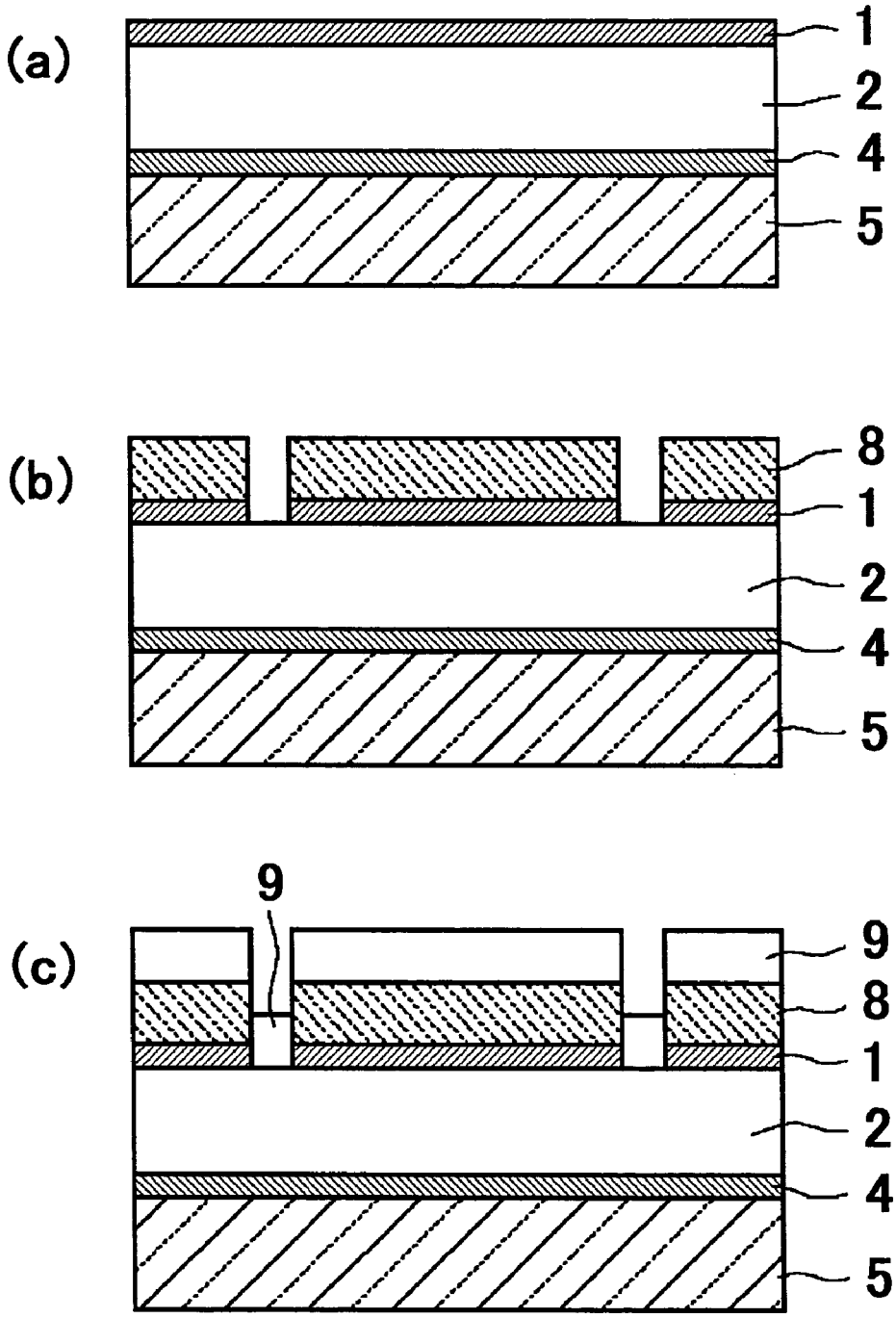
FIG. 10 is a cross-sectional view illustrating respective steps in an order in a method of fabricating a field emission type cold cathode in accordance with the fifth embodiment of the present invention.
Figure 11:
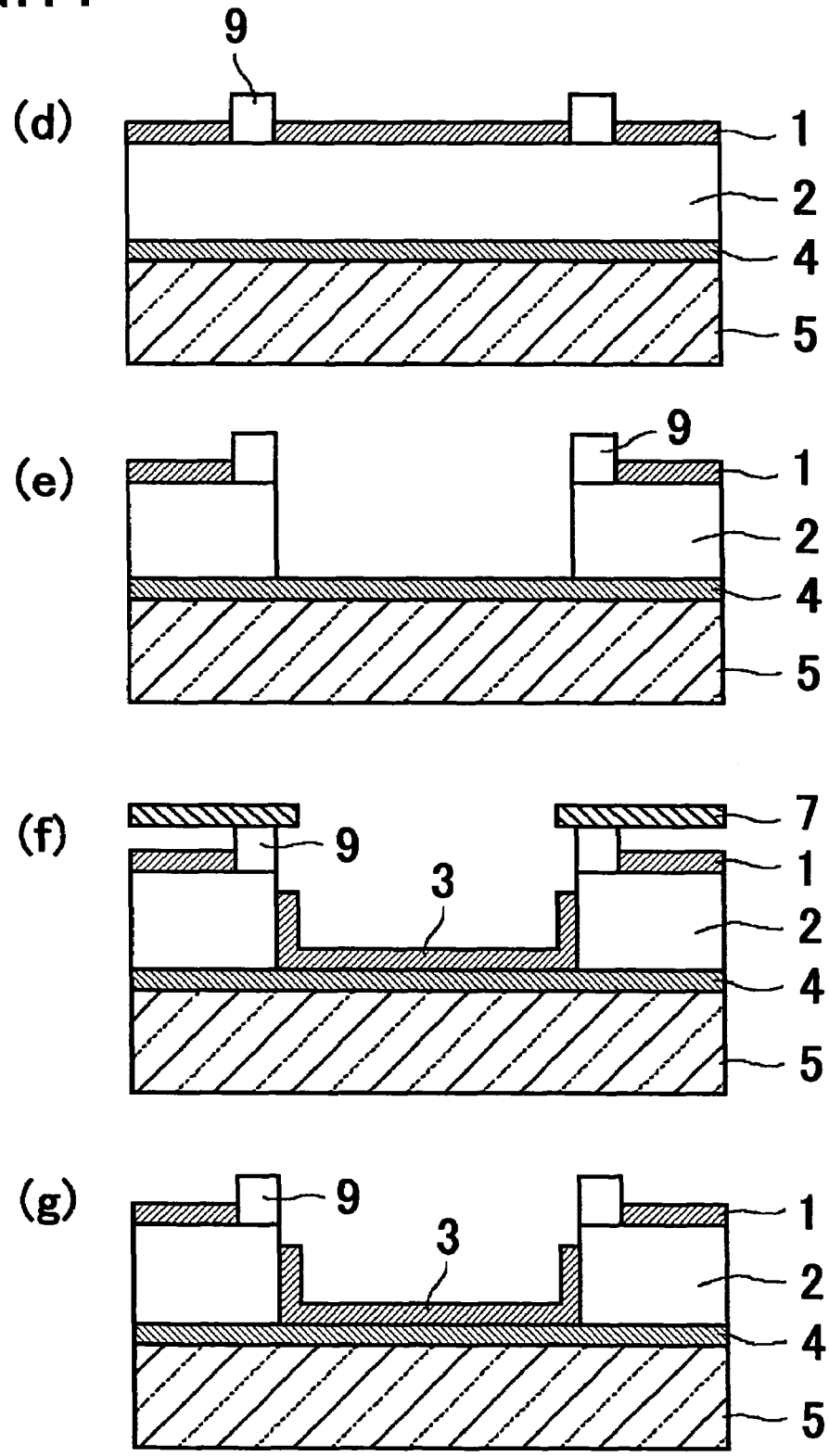
FIG. 11 is a cross-sectional view illustrating respective steps in an order in a method of fabricating a field emission type cold cathode in accordance with the fifth embodiment of the present invention.

FIGS. 10 and 11 are cross-sectional views illustrating respective steps in an order in a method of fabricating a field emission type cold cathode in accordance with the fifth embodiment of the present invention.

The method of fabricating a field emission type cold cathode in accordance with the fifth embodiment is different from the method of fabricating the field emission type cold cathode in accordance with the first embodiment, illustrated in FIG. 1, in additionally including a step of forming an electrically insulating film on an area corresponding to a difference in diameter between the openings 1*a* and 2*a*.

As illustrated in FIG. 10(*a*), as a substrate on which an emitter is to be fabricated, there is used a glass substrate 5 on which an electrically conductive layer 4 is formed.

In place of the glass substrate 5, an electrically conductive substrate may be used, similarly to the first embodiment.

Then, an electrically insulating layer 2 comprised of a silicon oxide film or a polyimide film and having a thickness of 4 micrometers is formed on the electrically conductive layer 4. Then, on the electrically insulating layer 2 is formed an aluminum layer having a thickness of 0.5 micrometers as a gate electrode layer 1.

Then, as illustrated in FIG. 10(*b*), there is formed a resist film 8 by photolithography. The resist film 8 has an opening in alignment with the area 2*b* (see FIG. 6) corresponding to a difference in diameter between the openings 1*a* and 2*a*. Then, the gate electrode layer 1 is etched for partial removal with the resist film 8 being used as a mask.

Then, as illustrated in FIG. 10(*c*), silicon oxide is deposited by a thickness of 1 micrometer to form an electrically insulating film 9. Since silicon oxide is deposited not only on the resist film 8, but also on the electrically insulating film 2 having been exposed by etching removal of the gate electrode layer 1, the electrically insulating film 9 is formed covering the resist film 8 and the electrically insulating film 2 therewith.

Then, as illustrated in FIG. 11(*d*), the resist film 8 and the electrically insulating film 9 formed on the resist film 8 are removed.

Then, there is formed a resist film (not illustrated) by photolithography. The gate electrode layer 1 and the electrically insulating film 2 are partially etched with the resist film being used as a mask to thereby form the openings 1*a* and 2*a*, as illustrated in FIG. 11(*e*).

In the fifth embodiment, the opening 2*a* formed throughout the electrically insulating film 2 is designed to have a diameter of 50 micrometers, and the opening 1*a* formed throughout the gate electrode layer 1 is designed to have a diameter of 52 micrometers.

Then, as illustrated in FIG. 11(*f*), an area other than the opening 2*a* is covered with a mask 7. Then, carbon nano-tube is deposited on a bottom and an inner sidewall of the opening 2*a* by a thickness of about 1.5 micrometers by spraying or screen-printing, to thereby form the emitter layer 3.

Then, the mask 7 is removed. Thus, as illustrated in FIG. 11(*g*), there is completed the field emission type cold cathode in accordance with the fifth embodiment.

The fifth embodiment provides the following advantages in comparison with the first embodiment.

The first advantage is reduction in an increase in a diameter of the opening 1*a* relative to a diameter of the opening 2*a*.

Specifically, the electrically insulating film 9 is formed in an area corresponding to a difference in diameter between the openings 1*a* and 2*a*, and a line connecting a point on the emitter layer 3 to an edge of the opening 1*a* is interrupted by the electrically insulating film 9. Thus, it is possible to minimize an increase in a diameter of the opening 1*a*. Specifically, whereas the opening 1*a* has a diameter of 60 micrometers by geometrically arranging layers in the first embodiment, the opening 1*a* can be designed to have a diameter of 52 micrometers in the fifth embodiment.

Since reduction in a diameter of the opening 1*a* suppresses projectional equipotential surfaces, an electric field existing at a surface of the emitter layer 3 in the opening 2*a* is intensified, ensuring that electrons are emitted at a lower voltage.

The second advantage is that electrical insulation between the gate electrode layer 1 and the emitter layer 3 can be improved.

In the first embodiment, since there is formed a gap between the mask 7 and the electrically insulating film 2, as illustrated in FIG. 1(*c*), carbon nano-tubes may be residual with the result of deterioration in electrical insulation between the gate electrode layer 1 and the emitter layer 3.

In contrast, the gate electrode layer 1 is completely separated from the mask 7 by the electrically insulating film 9, as illustrated in FIG. 11(*f*), in the fifth embodiment. Hence, even if carbon nano-tube is adhered to an inner wall of the electrically insulating film 9, carbon nano-tube cannot reach the gate electrode layer 1, ensuring significant improvement in electrical insulation between the gate electrode layer 1 and the emitter layer 3 in comparison with the first embodiment.

As having been explained in the third embodiment, after the removal of the mask 7, the carbon nano-tube layer formed on an inner sidewall of the opening 2*a* may be sharpened by means of an adhesive tape or by rubbing.

Sixth Embodiment

Figure 12:
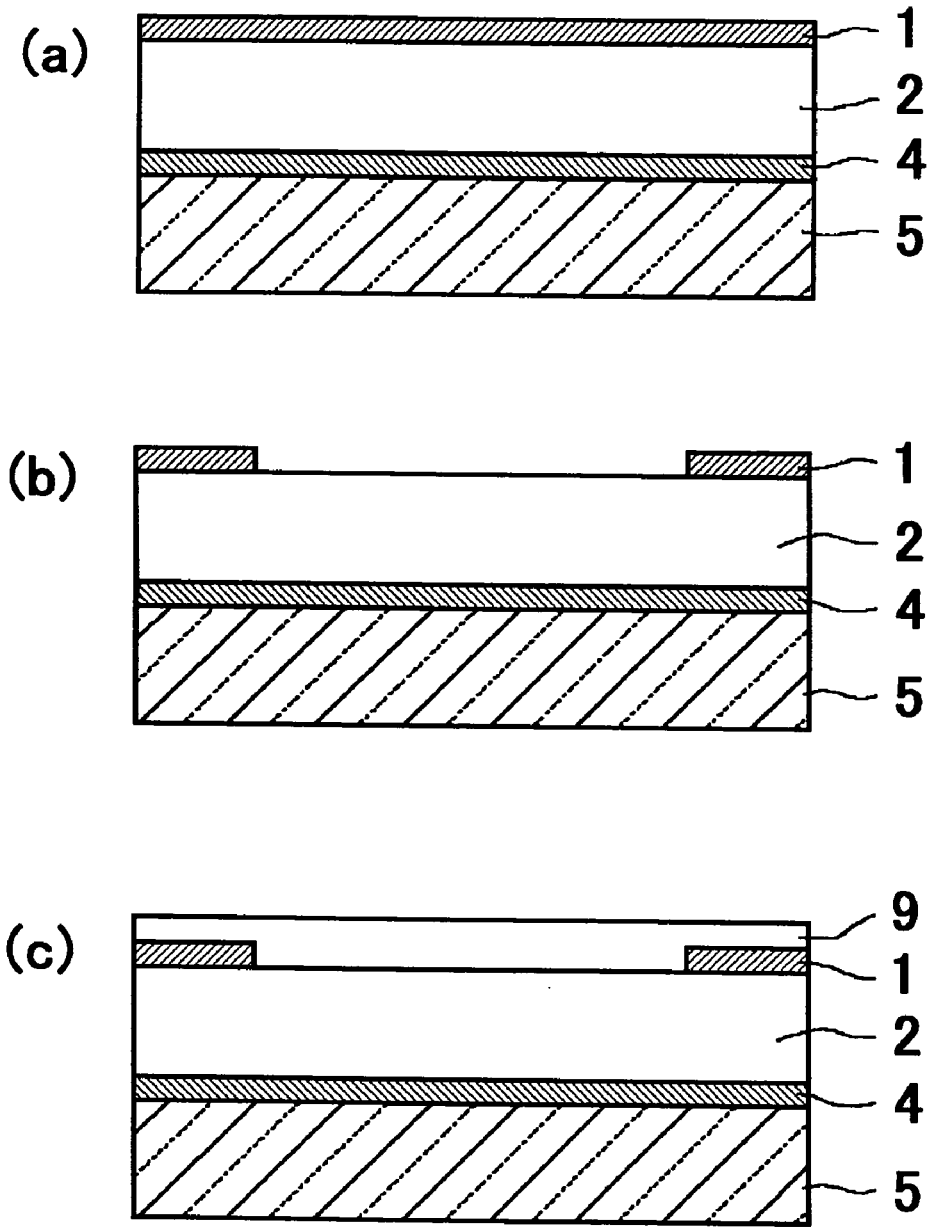
FIG. 12 is a cross-sectional view illustrating respective steps in an order in a method of fabricating a field emission type cold cathode in accordance with the sixth embodiment of the present invention.
Figure 13:
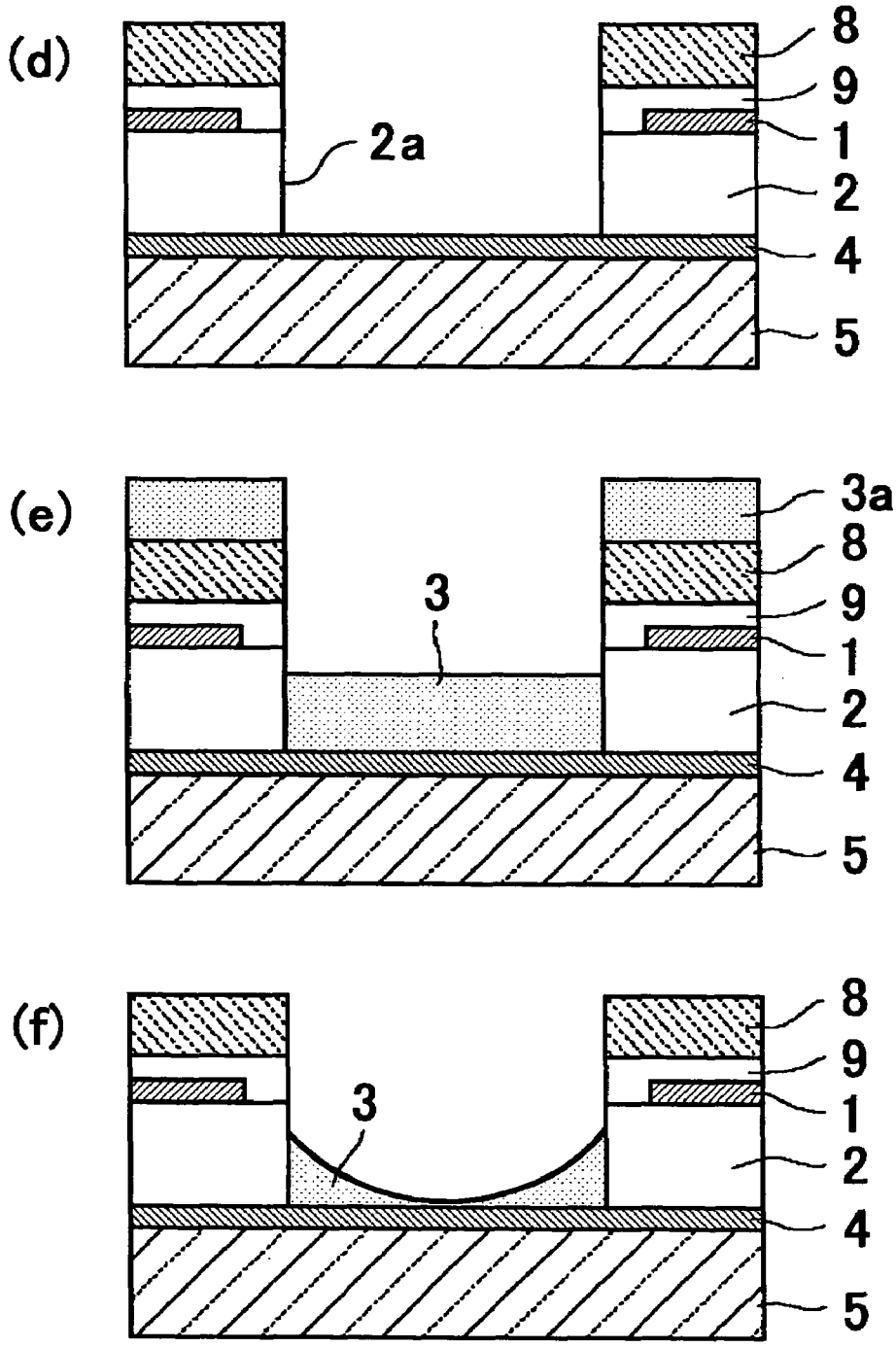
FIG. 13 is a cross-sectional view illustrating respective steps in an order in a method of fabricating a field emission type cold cathode in accordance with the sixth embodiment of the present invention.

FIGS. 12 and 13 are cross-sectional views illustrating respective steps in an order in a method of fabricating a field emission type cold cathode in accordance with the sixth embodiment of the present invention.

As illustrated in FIG. 12(*a*), as a substrate on which an emitter is to be fabricated, there is used a glass substrate 5 on which an electrically conductive layer 4 is formed. The electrically conductive layer 4 is comprised of an aluminum layer, for instance.

In place of the glass substrate 5, an electrically conductive substrate may be used, similarly to the first embodiment.

Then, an electrically insulating layer 2 comprised of a silicon oxide film or a polyimide film and having a thickness of 4 micrometers is formed on the electrically conductive layer 4. Then, on the electrically insulating layer 2 is formed an aluminum layer having a thickness of 0.5 micrometers as a gate electrode layer 1.

Then, as illustrated in FIG. 12(*b*), there is formed a resist film (not illustrated) by photolithography. The resist film has an opening in alignment with the opening 1*a* formed throughout the gate electrode layer 1. Then, the gate electrode layer 1 is etched for partial removal with the resist film being used as a mask.

Then, as illustrated in FIG. 12(*c*), silicon oxide is deposited by a thickness of 1 micrometer to thereby form an electrically insulating layer 9.

Then, there is formed a resist film 8 by photolithography. The resist film 8 has an opening in alignment with the opening 2*a*. Then, the electrically insulating films 9 and 2 are etched for partial removal with the resist film 8 being used as a mask to thereby form the opening 2*a*, as illustrated in FIG. 13(*d*).

Then, as illustrated in FIG. 13(*e*), carbon nano-tube is sprayed for deposition to have a thickness of about 3.5 micrometers in the opening 2*a*. Thus, an emitter layer 3 is formed in the opening 2*a*, and a carbon nano-tube layer 3*a* is formed on the resist film 8.

Then, the substrate 5 above which the resist film 8 is formed is rotated while being kept inclined by about 20 degrees, and focused ion beams are irradiated onto the substrate 5 such that the emitter 3 has a recessed surface, as illustrated in FIG. 13(*f*).

Thereafter, the resist film 8 is removed. Thus, the field emission type cold cathode in accordance with the sixth embodiment is completed.

Seventh Embodiment

Figure 14:
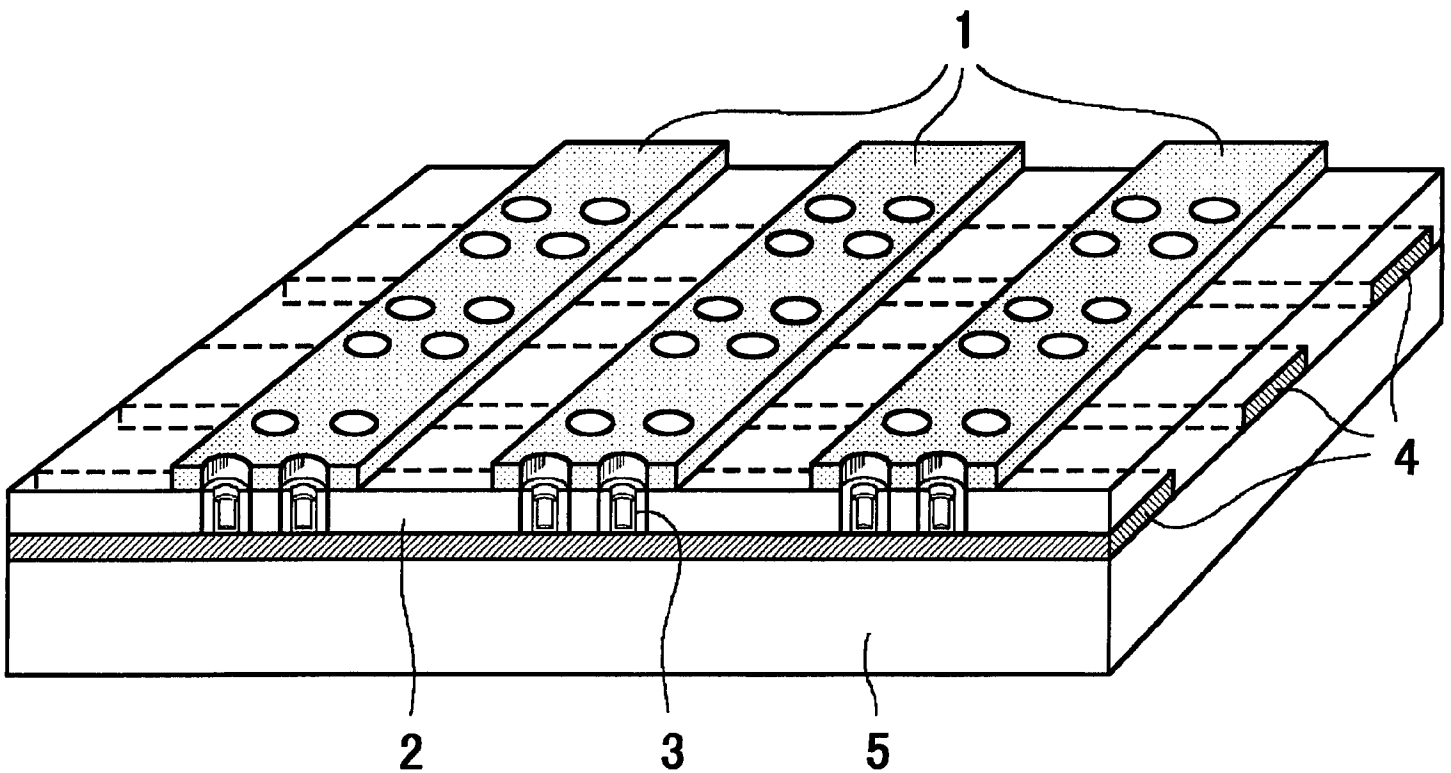
FIG. 14 is a perspective view of a planar image-displaying apparatus including a plurality of the field emission type cold cathodes in accordance with the first embodiment of the present invention.
Figure 15:
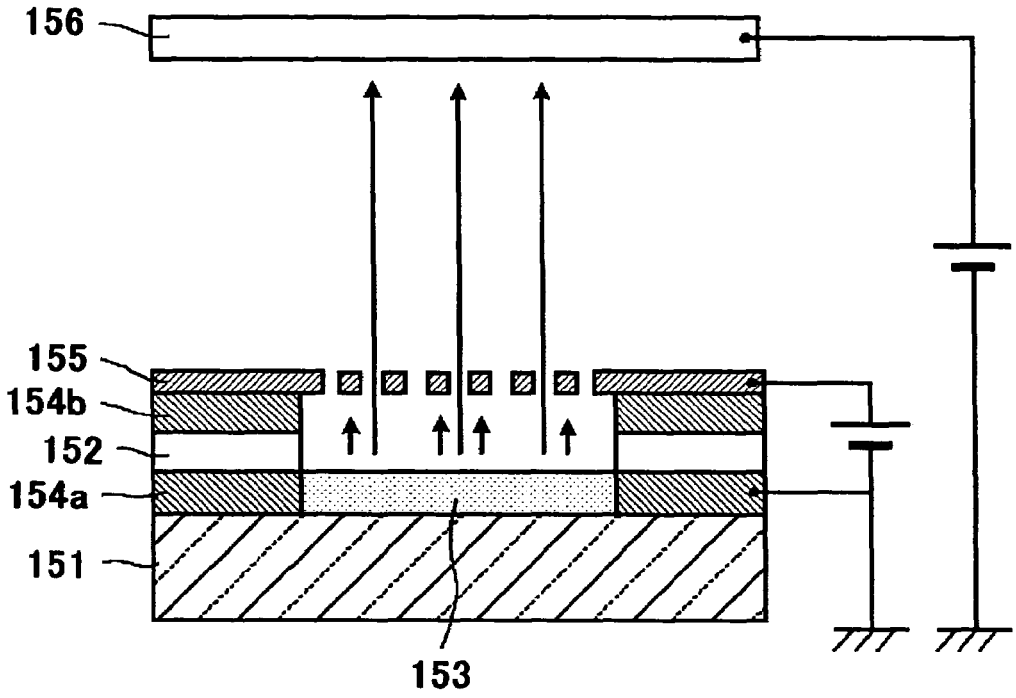
FIG. 15 is a cross-sectional view of a first conventional field emission type cold cathode.
Figure 16:
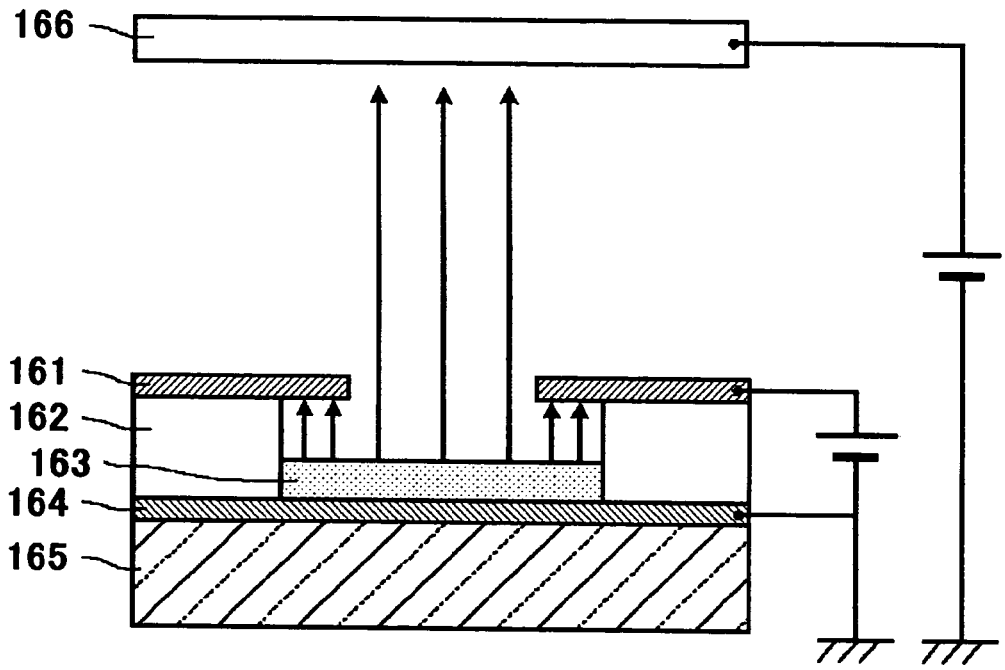
FIG. 16 is a cross-sectional view of a second conventional field emission type cold cathode.
Figure 17:
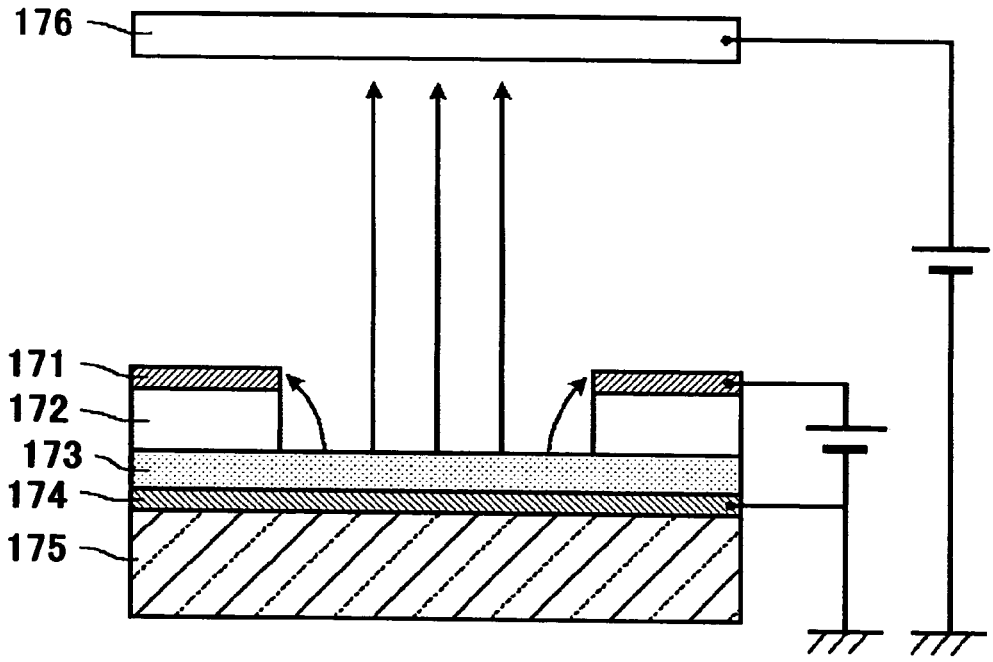
FIG. 17 is a cross-sectional view of a third conventional field emission type cold cathode.

FIG. 14 is a perspective view of a planar apparatus for displaying images, including the field emission type cold cathode in accordance with the first embodiment.

In accordance with the same process as a process for fabricating the field emission type cold cathode illustrated in FIG. 1, the electrically conductive layers 4 are formed on the substrate 5 in stripe by a thickness of 0.5 micrometers, and the electrically insulating film 2 comprised of an oxide film or a polyimide film is formed on the electrically conductive layers 4 and the substrate 5 by a thickness of 4 micrometers.

Then, the gate electrode layers 1 are formed in stripe to extend perpendicularly to the electrically conductive layers 4.

The gate electrode layers 1 and the electrically insulating film 2 are partially etched in areas in which the electrically conductive layers 4 and the gate electrode layers 1 intersect with each other, to thereby form the openings 1*a* and 2*a*. When the openings 1*a* and 2*a* are formed, the opening 1*a* is designed to have such a diameter that a line connecting any point on the carbon nano-tube layer formed on a bottom of the opening 2*a*, to an edge of the opening 1*a* closest to the point intersects with the electrically insulating layer 2.

In the seventh embodiment, the opening 1*a* formed throughout the gate electrode layer 1 is designed to have a diameter of 60 micrometers, and the opening 2*a* formed throughout the electrically insulating layer 2 is designed to have a diameter of 50 micrometers.

Then, an area other than the opening 2*a* is covered with the mask 7 (see FIG. 1(*c*)), and the emitter layer 3 is formed on a bottom and an inner sidewall of the opening 2*a* by spraying or screen-printing. Thus, there are fabricated electron-emitters associated with RGB pixels.

Though the emitter layer 3 in the seventh embodiment is formed in accordance with the method of fabricating the field emission type cold cathode in accordance with the first embodiment, the emitter layer may be formed in accordance with the method of fabricating the field emission type cold cathode in accordance with the other embodiments.

There is fabricated a planar image-displaying apparatus by arranging a glass substrate on which RGB phosphors are coated in stripes, in facing relation to the glass substrate 5 on which the emitter layer 3 is formed, with a vacuum space being sandwiched therebetween. The apparatus may be operated, for instance, by address-driving any pixels.

In the above-mentioned embodiments, the emitter layer 3 is composed of carbon nano-tube. However, the emitter layer 3 may be composed of a material other than carbon nano-tube. For instance, the emitter layer may be comprised of tubes composed of boron nitride (BN), silicon carbide (SiC) or metal, or a material having a low work function, such as diamond.

Deposition of a material of which the emitter layer is composed onto a bottom and an inner sidewall of the opening 2*a* may be carried out not only by spraying or screen-printing, but also by vapor deposition such as chemical vapor deposition (CVD) or sputtering.

INDUSTRIAL APPLICABILITY

As having been explained above, an emitter layer is formed not only on a bottom of an opening formed throughout an electrically insulating layer, but also on a sidewall of the electrically insulating layer, in the present invention. Thus, it is possible to shorten a distance between an emitter layer and a gate electrode layer regardless of a thickness of an electrically insulating layer, ensuring that a field emission type cold cathode can be driven at a low voltage.

In addition, since an opening formed throughout a gate electrode layer is designed to have a diameter greater than a diameter of an opening formed throughout an electrically insulating layer, it is possible to prevent electrons emitted from an emitter layer from flying directly into a gate electrode layer. Thus, there can be provided a field emission type cold cathode having a high emission efficiency and a planar image-displaying apparatus including such a field emission type cold cathode.

The invention claimed is:

1. A method of fabricating a field emission type cold cathode, including:

a first step of forming an electrically insulating layer and a gate electrode layer in this order on a substrate at least a surface of which is electrically conductive;

a second step of partially removing said gate electrode layer and said electrically insulating layer such that said electrically insulating layer is formed therethrough with a first opening and said gate electrode layer is formed therethrough with a second opening almost concentric with said first opening and having a minimum diameter equal to or greater than a maximum diameter of said first opening;

a third step of forming a mask on said gate electrode layer which mask is formed with a third opening above said first opening; and a fourth step of depositing a material of which an emitter layer is composed, in said first opening through said mask to form an emitter layer on a bottom and on an inner sidewall of said first opening at the maximum diameter of said first opening, wherein said mask is comprised of a metal mask.

2. The method as set forth in claim 1, wherein said second opening is formed to have such a diameter that a line connecting any point on said emitter layer to an edge of said second opening in a minimum distance intersects with said electrically insulating layer.

3. The method as set forth in claim 2, wherein a distance D between an edge of said first opening and said edge of said second opening is defined as $$D \geqq tg \times d/(2ti)$$

wherein "d" indicates the maximum diameter of said first opening, "tg" indicates a thickness of said gate electrode layer, and "ti" indicates a vertical distance between an uppermost part of said emitter layer ata center of said first opening and a lowermost level of said gate electrode layer.

4. The method as set forth in claim 1, wherein said emitter formed on said inner sidewall of said first opening in said fourth step has a maximum height as viewed from a bottom of said first opening, lower than a line connecting a center of said emitter layer to an upper edge of said second opening.

5. The method asset forth in claim 1, wherein said emitter layer formed on said inner sidewall of said first opening in said fourth step has an arcuate recessed upper surface and a height that increases from a center of said first opening towards said inner sidewall of said first opening.

6. The method as set forth in claim 1, wherein said material of which said emitter layer is composed is deposited in said fourth step by screen-printing, chemical vapor deposition or sputtering.

7. The method as set forth in claim 1, wherein said second opening is formed throughout said gate electrode layer in said second step such that an edge thereof is set back relative to an edge of said first opening.

8. The method as set forth in claim 7, further including a step of forming a second electrically insulating layer on said electrically insulating layer and within said second opening.

9. The method as set forth in claim 8, wherein said second electrically insulating layer is formed to have a thickness greater than a thickness of said gate electrode layer.

10. The method as set forth in claim 1, wherein said emitter layer is formed in said fourth step such that a maximum height of said emitter layer formed on said inner sidewall of said first opening, as viewed from a bottom of said first opening, is smaller than a maximum height of said electrically insulating layer.

11. The method as set forth in claim 1, wherein said first and second openings are formed in common photolithography.

12. A method of fabricating a field emission type cold cathode, including:

a first step of forming an electrically insulating layer and a gate electrode layer in this order on a substrate at least a surface of which is electrically conductive;

a second step of partially removing said gate electrode layer and said electrically insulating layer such that said electrically insulating layer is formed therethrough with a first opening and said gate electrode layer is formed therethrough with a second opening almost concentric with said first opening and having a minimum diameter equal to or greater than a maximum diameter of said first opening;

a third step of forming a mask on said gate electrode layer which mask is formed with a third opening above said first opening; and a fourth step of depositing a material of which an emitter layer is composed, in said first opening through said mask to form an emitter layer on a bottom and on an inner sidewall of said first opening at the maximum diameter of said first opening, wherein said third opening is smaller in area than said first opening, and an edge of said first opening is covered with said mask.

13. A method of fabricating a field emission type cold cathode, including:

a first step of forming an electrically insulating layer and a gate electrode layer in this order on a substrate at least a surface of which is electrically conductive;

a second step of partially removing said gate electrode layer and said electrically insulating layer such that said electrically insulating layer is formed therethrough with a first opening and said gate electrode layer is formed therethrough with a second opening almost concentric with said first opening and having a minimum diameter equal to or greater than a maximum diameter of said first opening;

a third step of forming a mask on said gate electrode layer which mask is formed with a third opening above said first opening; and a fourth step of depositing a material of which an emitter layer is composed, in said first opening through said mask to form an emitter layer on a bottom and on an inner sidewall of said first opening at the maximum diameter of said first opening, wherein said material of which said emitter layer is composed is deposited in said fourth step by spraying.

14. A method of fabricating a field emission type cold cathode, including:

a first step of forming an electrically insulating layer and a gate electrode layer in this order on a substrate at least a surface of which is electrically conductive;

a second step of partially removing said gate electrode layer and said electrically insulating layer such that said electrically insulating layer is formed therethrough with a first opening and said gate electrode layer is formed therethrough with a second opening almost concentric with said first opening and having a minimum diameter equal to or greater than a maximum diameter of said first opening;

a third step of forming a mask on said gate electrode layer which mask is formed with a third opening above said first opening; and a fourth step of depositing a material of which an emitter layer is composed, in said first opening through said mask to form an emitter layer on a bottom and on an inner sidewall of said first opening at the maximum diameter of said first opening, wherein said material of which said emitter layer is composed is deposited in said fourth step obliquely in an angle in the range of 15 to 45 degrees both inclusive relative to a normal line vertically extending from said substrate with said substrate being rotated.

15. A method of fabricating a field emission type cold cathode, including:

a first step of forming an electrically insulating layer and a gate electrode layer in this order on a substrate at least a surface of which is electrically conductive;

a second step of partially removing said gate electrode layer and said electrically insulating layer such that said electrically insulating layer is formed therethrough with a first opening and said gate electrode layer is formed therethrough with a second opening almost concentric with said first opening and having a minimum diameter equal to or greater than a maximum diameter of said first opening;

a third step of forming a mask on said gate electrode layer which mask is formed with a third opening above said first opening; and a fourth step of depositing a material of which an emitter layer is composed, in said first opening through said mask to form an emitter layer on a bottom and on an inner sidewall of said first opening at the maximum diameter of said first opening, further including a fifth step of, after said emitter layer has been formed, removing an edge of said emitter layer formed on said inner sidewall of said first opening.

16. The method as set forth in claim 15, wherein said fifth step is carried out by adhering an adhesive tape to said edge of said emitter layer and peeling off said adhesive tape, rubbing, etching, or a combination of etching, and adhering an adhesive tape to said edge of said emitter layer and peeling off said adhesive tape.

* * * * *